US010493596B2

(12) United States Patent
Keipert et al.

(10) Patent No.: US 10,493,596 B2
(45) Date of Patent: Dec. 3, 2019

(54) COATED ABRASIVE ARTICLE WITH MULTIPLEXED STRUCTURES OF ABRASIVE PARTICLES AND METHOD OF MAKING

(71) Applicant: 3M INNOVATIVE PROPERTIES COMPANY, St. Paul, MN (US)

(72) Inventors: Steven J. Keipert, Houlton, WI (US); John T. Boden, White Bear Lake, MN (US); Scott R. Culler, Burnsville, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 206 days.

(21) Appl. No.: 15/503,424

(22) PCT Filed: Aug. 17, 2015

(86) PCT No.: PCT/US2015/045505
§ 371 (c)(1),
(2) Date: Feb. 13, 2017

(87) PCT Pub. No.: WO2016/028683
PCT Pub. Date: Feb. 25, 2016

(65) Prior Publication Data

US 2017/0225299 A1 Aug. 10, 2017

Related U.S. Application Data

(60) Provisional application No. 62/040,172, filed on Aug. 21, 2014.

(51) Int. Cl.
*B24D 11/00* (2006.01)
*B24D 3/28* (2006.01)

(52) U.S. Cl.
CPC ..... *B24D 11/005* (2013.01); *B24D 3/28* (2013.01); *B24D 11/001* (2013.01); *B24D 2203/00* (2013.01)

(58) Field of Classification Search
CPC ..... B24D 3/28; B24D 11/005; B24D 2203/00
(Continued)

(56) References Cited

U.S. PATENT DOCUMENTS 1,910,444 A 5/1933 Nicholson
2,755,607 A * 7/1956 Haywood ..... B24D 11/00 451/527

(Continued)

FOREIGN PATENT DOCUMENTS

CN 101653925 2/2010
WO WO 2014/008049 1/2014

(Continued)

*Primary Examiner* — George B Nguyen
(74) *Attorney, Agent, or Firm* — Aleksander Medved

(57) ABSTRACT

The method generally involves the steps of filling the cavities in a production tool each with an individual abrasive particle. Aligning a filled production tool and a resin coated backing for transfer of the abrasive particles to the resin coated backing. Transferring the abrasive particles from the cavities onto the resin coated backing and removing the production tool from the aligned position with the resin coated backing. Thereafter the resin layer is cured, a size coat is applied and cured and the coated abrasive article is converted to sheet, disk, or belt form by suitable converting equipment.

19 Claims, 14 Drawing Sheets

(58) Field of Classification Search
USPC ..... 451/527
See application file for complete search history.

(56) References Cited

U.S. PATENT DOCUMENTS

| | | | | | |
|---|---|---|---|---|---|
| 3,041,156 | A | | 6/1962 | Rowse | |
| 3,774,355 | A | * | 11/1973 | Dawson | B23D 65/00 451/527 |
| 4,055,029 | A | * | 10/1977 | Kalbow | A47L 13/16 451/527 |
| 4,314,827 | A | | 2/1982 | Leitheiser | |
| 4,623,364 | A | | 11/1986 | Cottringer | |
| 4,652,275 | A | | 3/1987 | Bloecher | |
| 4,744,802 | A | | 5/1988 | Schwabel | |
| 4,770,671 | A | | 9/1988 | Monroe | |
| 4,799,939 | A | | 1/1989 | Bloecher | |
| 4,881,951 | A | | 11/1989 | Wood | |
| 4,997,461 | A | | 3/1991 | Markhoff-Matheny | |
| 5,009,675 | A | | 4/1991 | Kunz | |
| 5,011,508 | A | | 4/1991 | Wald | |
| 5,042,991 | A | | 8/1991 | Kunz | |
| 5,085,671 | A | | 2/1992 | Martin | |
| 5,152,917 | A | | 10/1992 | Pieper | |
| 5,201,916 | A | | 4/1993 | Berg | |
| 5,213,591 | A | | 5/1993 | Celikkaya | |
| 5,352,254 | A | | 10/1994 | Celikkaya | |
| 5,366,523 | A | | 11/1994 | Rowenhorst | |
| 5,435,816 | A | | 7/1995 | Spurgeon | |
| 5,489,235 | A | * | 2/1996 | Gagliardi | B24D 11/00 451/527 |
| RE35,570 | E | | 7/1997 | Rowenhorst | |
| 5,672,097 | A | | 9/1997 | Hoopman | |
| 5,820,450 | A | * | 10/1998 | Calhoun | B24D 11/005 451/530 |
| 5,946,991 | A | | 9/1999 | Hoopman | |
| 5,975,987 | A | | 11/1999 | Hoopman | |
| 5,984,988 | A | | 11/1999 | Berg | |
| 6,129,540 | A | | 10/2000 | Hoopman | |
| 6,537,140 | B1 | * | 3/2003 | Miller | B24D 11/00 451/259 |
| 7,169,029 | B2 | * | 1/2007 | Petersen | B24D 11/005 451/523 |
| 7,300,479 | B2 | | 11/2007 | McArdle et al. | |
| 8,034,137 | B2 | | 10/2011 | Erickson | |
| 8,142,531 | B2 | | 3/2012 | Adefris | |
| 8,142,532 | B2 | | 3/2012 | Erickson | |
| 8,142,891 | B2 | | 3/2012 | Culler | |
| 2002/0026752 | A1 | | 3/2002 | Culler | |
| 2005/0064805 | A1 | | 3/2005 | Culler | |
| 2007/0232200 | A1 | * | 10/2007 | Natsui | B24B 7/228 451/41 |
| 2009/0165394 | A1 | | 7/2009 | Culler | |
| 2009/0169816 | A1 | | 7/2009 | Erickson | |
| 2012/0227333 | A1 | | 9/2012 | Adefris | |
| 2013/0040537 | A1 | | 2/2013 | Schwabel | |
| 2013/0125477 | A1 | | 5/2013 | Adefris | |
| 2013/0186006 | A1 | | 7/2013 | Kavanaugh | |
| 2014/0106126 | A1 | | 4/2014 | Gaeta | |

FOREIGN PATENT DOCUMENTS

| | | |
|---|---|---|
| WO | WO 2015/100018 | 7/2015 |
| WO | WO 2015/100020 | 7/2015 |
| WO | WO 2015/100220 | 7/2015 |

* cited by examiner

COATED ABRASIVE ARTICLE WITH MULTIPLEXED STRUCTURES OF ABRASIVE PARTICLES AND METHOD OF MAKING

CROSS REFERENCE TO RELATED APPLICATIONS

This application is a national stage filing under 35 U.S.C. 371 of PCT/US2015/045505, filed 17 Aug. 2015, which claims the benefit of U.S. Provisional Patent Application No. 62/040,172, filed 21 Aug. 2014, the disclosures of which are incorporated by reference in their entirety herein.

TECHNICAL FIELD

The present disclosure broadly relates to abrasive particles and methods of using them to make various abrasive articles.

BACKGROUND

Coated abrasive articles are conventionally coated by either drop coating or electrostatic coating of the abrasive particles onto a resin-coated backing. Of the two methods, electrostatic coating has been often preferred, as it provides some degree of orientation control for grains having an aspect ratio other than one. In general, positioning and orientation of the abrasive particles and their cutting points is important in determining abrasive performance.

SUMMARY

The orientation of abrasive particles with respect to the cutting direction in an abrasive article is important. The cutting efficiency and abrasive particle fracture mechanism varies with abrasive particle orientation. With triangular shaped abrasive particles, for improved cut and breakdown, it is generally preferred that the abrasive article and/or workpiece relative motion is such that the edge of the triangle is presented in the motion of cutting instead of the triangle's face. If the triangular face is presented to the direction of cutting, often the triangle will fracture near the base and out of the grinding plane resulting in no further abrading by that particular triangular shaped abrasive particle.

The spacing of the abrasive particles in an abrasive article can also be important. Conventional methods such as drop coating and electrostatic deposition provide a random distribution of spacing and intermittent, random clumping often results where two or three shaped abrasive particles end up touching each other near the tips or upper surfaces of the shaped abrasive particles with the shaped abrasive particles disposed at a random angle to the other. A clump loosely resembles a pyramid formed by two shaped abrasive particles leaning into each other. Random clumping can lead to poor cutting performance due to poor alignment of the shaped abrasive particles with respect to the intended relative motion, local enlargement of wear flats in these regions as the abrasive is used and inability of the shaped abrasive particles in the clump to properly fracture and breakdown during use because of mutual mechanical reinforcement. This creates grain dulling and wears flats, often capped with metal from the workpiece resulting in undesirable heat buildup compared to coated abrasive articles having more specified patterns and spacing for the shaped abrasive particles.

In view of the above, it would be desirable to have alternative methods and apparatus that are useful for positioning and orienting abrasive particles (especially shaped abrasive particles) in close proximity to each other while avoiding the problems of clustering from electrostatic and drop coating methods.

Pending PCT Patent Application Nos. PCT/US2014/069726, PCT/US2014/071855 and PCT/US2014/069680 disclose a method of making abrasive articles, an apparatus for making abrasive articles, and production tooling for an abrasive particle positioning system and are herein incorporated by reference. A production tool having a plurality of cavities dimensioned to hold a single shaped abrasive particle is provided for precise positioning, rotational orientation, and transfer of the shaped abrasive particles to a coated backing thereby forming an engineered abrasive layer where the X-Y spacing and rotational orientation of a majority, 60%, 70%, 80%, 90%, or 95% of each shaped abrasive particle in the abrasive layer can be predetermined and controlled for a specific grinding application.

The inventor has now determined that when the shaped abrasive particle's thickness is reduced to less than one-half the width of the cavity opening in the production tooling, it was unexpectedly found that this allowed for two, three, or even four or more shaped abrasive particles to fill each cavity in the production tooling oriented in the same manner as the previously used single large shaped abrasive particle. Under certain grinding conditions, two or more shaped abrasive particles in close proximity and in the same radial orientation produced superior grinding results than a single shaped abrasive particle of equivalent overall thickness and avoided the problems discussed above with random clumping. Therefore a production tool having a plurality of cavities dimensioned to hold at least two shaped abrasive particles is provided for precise positioning, rotational orientation, and transfer of the shaped abrasive particles to a coated backing thereby forming an engineered abrasive layer having multiplexed abrasive structures where the X-Y spacing and rotational orientation of at least 30%, 40%, 50%, 60%, 70%, 80%, 90%, or 95% of each shaped abrasive particle in the abrasive layer can be predetermined and controlled for a specific grinding application.

In the case of equilateral, triangular plates for the shaped abrasive particles, in one embodiment, the faces of the shaped abrasive particles can be parallel to each other and in close proximity with the faces spaced apart less than the thickness of the particles or touching. The shaped abrasive particles are duplexed, triplexed, or multiplexed within each cavity into layers of the individual shaped abrasive particles forming one larger multiplexed abrasive structure. These multiplexed abrasive structures are then transferred from the cavities of the production tooling onto a coated backing such that a pre-determined pattern of multiplexed abrasive structures are formed in the abrasive layer with each multiplexed abrasive structure spaced a predetermined distance in the X and Y directions from adjacent multiplexed abrasive structures and having a pre-determined rotational orientation about the Z-axis.

In one embodiment, the invention resides in a coated abrasive article comprising: a backing and an abrasive layer adhered to the backing by a make coat; wherein the abrasive layer comprises; a patterned abrasive layer of multiplexed abrasive structures, the multiplexed abrasive structures comprising two or more shaped abrasive particles in close proximity to each other; and each multiplexed abrasive structure spaced a predetermined distance from adjacent multiplexed abrasive structures forming the patterned abrasive layer.

In another embodiment, the inventions resides in a method of making a patterned abrasive layer on a resin coated backing comprising the steps of: providing a production tool having a dispensing surface with cavities spaced a predetermined distance from each other; filling at least 30% of the cavities in the dispensing surface with two or more shaped abrasive particles in an individual cavity creating a multiplexed abrasive structure comprising two or more shaped abrasive particles in close proximity to each other; aligning a resin coated backing with the dispensing surface with the resin layer facing the dispensing surface; transferring the shaped abrasive particles in the cavities to the resin coated backing and attaching the shaped abrasive particles to the resin layer; and removing the production tool to expose the multiplexed abrasive structures in a patterned abrasive layer on the resin coated backing.

As used herein, the term "precisely-shaped" in reference to abrasive particles or cavities in a carrier member respectively refers to abrasive particles or cavities having three-dimensional shapes that are defined by relatively smooth-surfaced sides that are bounded and joined by well-defined sharp edges having distinct edge lengths with distinct endpoints defined by the intersections of the various sides.

As used herein, the term "removably and completely disposed within" in reference to a cavity means that the abrasive particle is removable from the cavity by means of gravity alone, although in practice other forces may be used (e.g., air pressure, vacuum or mechanical impact or vibration).

As used herein, the term "predetermined" means that the production tool used has a plurality of cavities spaced a known distance from each other in the X and Y directions on the dispensing surface and the rotational orientation of the cavity opening about the Z-axis extending perpendicular to the dispensing surface is selected and known. The spacing and rotational orientation of each of the cavities forms a cavity pattern in the dispensing surface. When the production tool is filled with shaped abrasive particles and transferred to a coated backing to form an abrasive layer, the shaped abrasive particles substantially replicate the tooling's cavity pattern in the abrasive layer. Perfect replication is not required as some cavities may not be filled with a shaped abrasive particle, either intentionally or unintentionally, and the spacing or orientation may be slightly different as a result of the process of transferring the shaped abrasive particles out of the cavities and onto the coated backing.

As used herein, the term "multiplexed abrasive structure" means two or more shaped abrasive particles in close proximity to each other and wherein the rotational orientation about a Z axis extending from the patterned abrasive layer of each shaped abrasive particle in the multiplexed abrasive structure is substantially the same. In some embodiments, close proximity means that the spacing between each shaped abrasive particle in the multiplexed abrasive structure is less than the width of the shaped abrasive particles, less than ¾, ½, or ¼ the width of the shaped abrasive particles in the multiplexed abrasive structure, or such that each shaped abrasive particle in the multiplexed abrasive structure is touching the adjacent shaped abrasive particle. In some embodiments, substantially the same rotational orientation means, each shaped abrasive particle in the multiplexed abrasive structure has a rotational orientation within ±30 degrees, ±20 degrees, ±10 degrees, or ±5 degrees.

Features and advantages of the present disclosure will be further understood upon consideration of the detailed description as well as the appended claims.

DETAILED DESCRIPTION

Coated Abrasive Article Maker Apparatus

Figure 1:
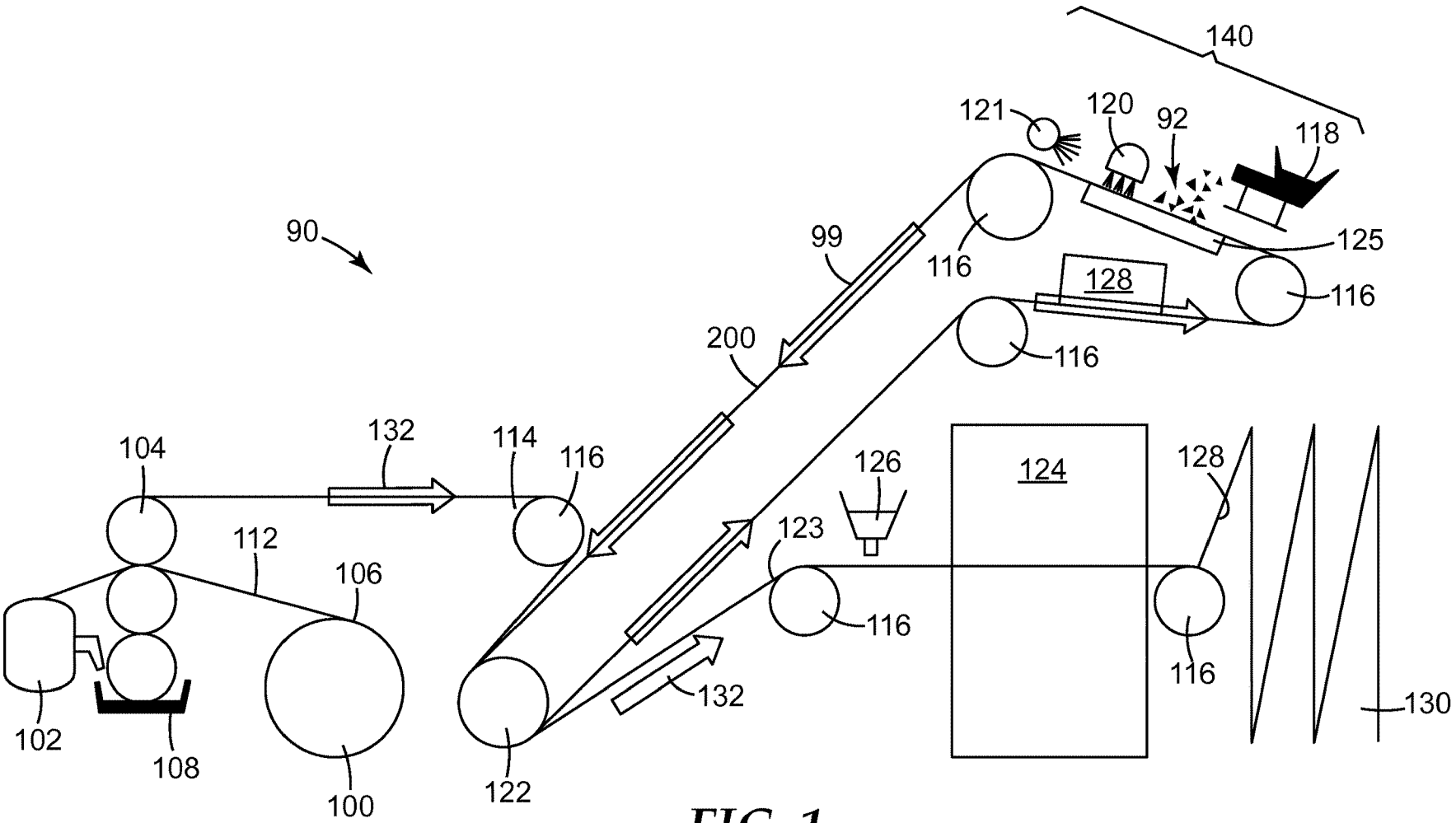
FIG. 1 is schematic view of an apparatus for making a coated abrasive article according to the present disclosure.
Figure 2A:
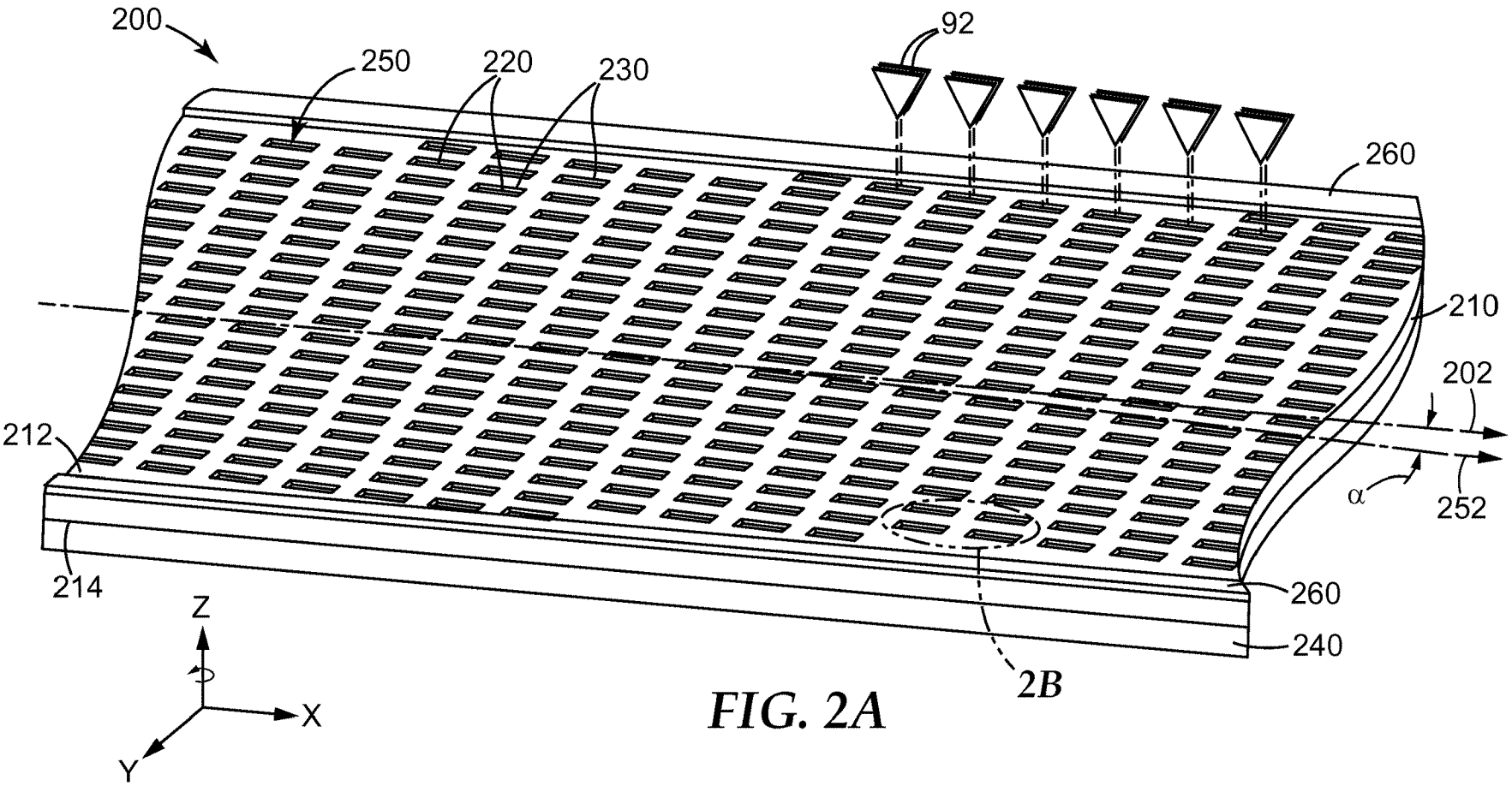
FIG. 2A is a schematic perspective view of an exemplary production tool 200 according to the present disclosure.
Figure 2C:
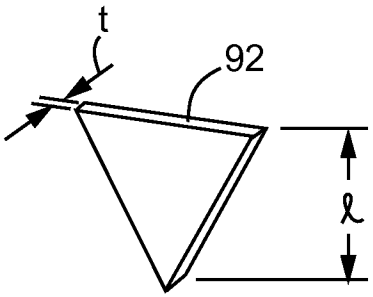
FIG. 2C is an enlarged view of a shaped abrasive particle
Figure 2B:
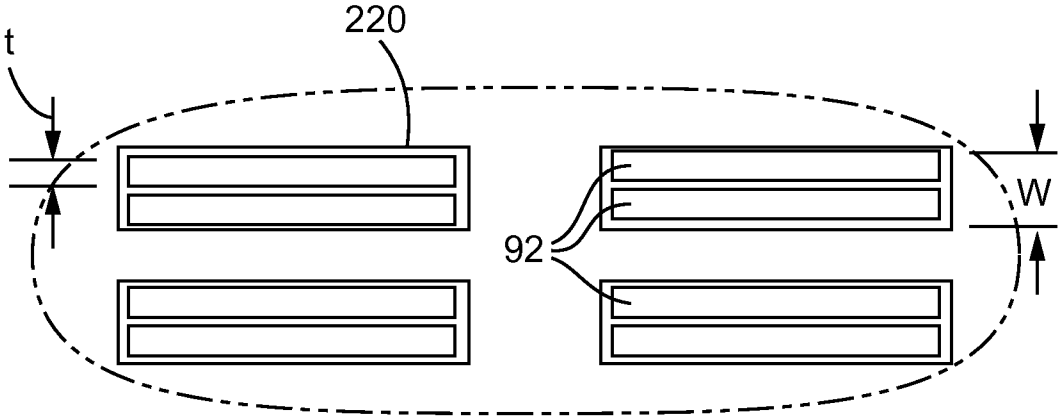
FIG. 2B is an enlarged view of the area circled in FIG. 2A.

Referring now to FIG. 1, and FIG. 2, a coated abrasive article maker apparatus 90 according to the present disclosure includes abrasive particles 92 removably disposed within cavities 220 of a production tool 200 having a first web path 99 guiding the production tool through the coated abrasive article maker such that it wraps a portion of an outer circumference of an abrasive particle transfer roll 122. The apparatus typically includes, for example, an unwind 100, a make coat delivery system 102, and a make coat applicator 104. These components unwind a backing 106, deliver a make coat resin 108 via the make coat delivery system 102 to the make coat applicator 104 and apply the make coat resin to a first major surface 112 of the backing. Thereafter the resin coated backing 114 is positioned by an idler roll 116 for application of the abrasive particles 92 to the first major surface 112 coated with the make coat resin 108. A second web path 132 for the resin coated backing 114 guides the resin coated backing through the coated abrasive article maker apparatus such that it wraps a portion of the outer circumference of the abrasive particle transfer roll 122 with the resin layer positioned facing the dispensing surface of the production tool that is positioned between the resin coated backing 114 and the outer circumference of the abrasive particle transfer roll 122. Suitable unwinds, make coat delivery systems, make coat resins, coaters and backings are known to those of skill in the art. The make coat delivery system 102 can be a simple pan or reservoir containing the make coat resin or a pumping system with a storage tank and delivery plumbing to translate the make coat resin to the needed location. The backing 106 can be a cloth, paper, film, nonwoven, scrim, or other web substrate. The make coat applicator can be, for example, a coater, a roll coater, a spray system, or a rod coater. Alternatively, a pre-coated coated backing can be positioned by the idler roll 116 for application of the abrasive particles to the first major surface.

As described herein later, the production tool 200 comprises a plurality of cavities 220 having a complimentary shape to the intended abrasive particle to be contained therein. An abrasive particle feeder 118 supplies at least some abrasive particles to the production tool. Preferably, the abrasive particle feeder 118 supplies an excess of abrasive particles such that there are more abrasive particles present per unit length of the production tool in the machine direction than cavities present. Supplying an excess of abrasive particles helps to ensure all cavities within the production tool are eventually filled with an abrasive particle. Since the bearing area and spacing of the abrasive particles is often designed into the production tooling for the specific grinding application it is desirable to not have too many unfilled cavities. The abrasive particle feeder 118 is typically the same width as the production tool and supplies abrasive particles across the entire width of the production tool. The abrasive particle feeder 118 can be, for example, a vibratory feeder, a hopper, a chute, a silo, a drop coater, or a screw feeder.

Optionally, a filling assist member 120 is provided after the abrasive particle feeder 118 to move the abrasive particles around on the surface of the production tool 200 and to help orientate or slide the abrasive particles into the cavities 220. The filling assist member 120 can be, for example, a doctor blade, a felt wiper, a brush having a plurality of bristles, a vibration system, a blower or air knife, a vacuum box 125, or combinations thereof. The filling assist member moves, translates, sucks, or agitates the abrasive particles on the dispensing surface 212 (top or upper surface of the production tool 200 in FIG. 1) to place more abrasive particles into the cavities. Without the filling assist member, generally at least some of abrasive particles dropped onto the dispensing surface 212 will fall directly into a cavity and no further movement is required but others may need some additional movement to be directed into a cavity. Optionally, the filling assist member 120 can be oscillated laterally in the cross machine direction or otherwise have a relative motion such as circular or oval to the surface of the production tool 200 using a suitable drive to assist in completely filling each cavity 220 in the production tool with an abrasive particle. Typically if a brush is used as the filling assist member, the bristles may cover a section of the dispensing surface from 2-4 inches (5.0-10.2 cm) in length in the machine direction preferably across all or most all of the width of the dispensing surface, and lightly rest on or just above the dispensing surface, and be of a moderate flexibility. A vacuum box 125, if used as the filling assist member, is often used in conjunction with a production tool having cavities extending completely through the production tooling; however, even a production tool having a solid back surface can be an advantage since it will flatten and draw the production tooling more planar for improved filling of the cavities. The vacuum box 125 is located near the abrasive particle feeder 118 and may be located before or after the abrasive particle feeder, or encompass any portion of a web span between a pair of idler rolls 116 in the abrasive particle filling and excess removal section of the apparatus generally illustrated at 140. Alternatively, the production tool can be supported or pushed on by a shoe or a plate to assist in keeping it planar in this section of the apparatus instead or in addition to the vacuum box 125. In embodiments, where the abrasive particle is fully contained within the cavity of the production tooling, that is to say where the majority (e.g., 80, 90, or 95 percent) of the abrasive particles in the cavities do not extend past the dispensing surface of the production tooling, it is easier for the filling assist member to move the abrasive particles around on the dispensing surface of the production tooling without dislodging an individual abrasive particle already contained within an individual cavity.

Optionally, as the production tool advances in the machine direction, the cavities 220 move to a higher elevation and can optionally reach a higher elevation than the abrasive particle feeder's outlet for dispensing abrasive particles onto the dispensing surf ace of the production tool. If the production tool is an endless belt, the belt can have a positive incline to advance to a higher elevation as it moves past the abrasive particle feeder 118. If the production tool is a roll, the abrasive particle feeder 118 can be positioned such that it applies the abrasive particles to the roll before top dead center of the roll's outer circumference such as between 270 degrees to 350 degrees on the face of the roll with top dead center being 0 degrees as one progresses clockwise about the roll with the roll turning in a clockwise in operation. It is believed that applying the abrasive particles to an inclined dispensing surface 212 of the production tool can enable better filling of the cavities. The abrasive particles can slide or tumble down the inclined dispensing surface 212 of the production tool thereby enhancing the possibility of falling into a cavity. In embodiments, where the abrasive particle is fully contained within the cavity of the production tooling, that is to say where the majority (e.g., 80, 90, or 95 percent) of the abrasive particles in the cavities do not extend past the dispensing surface of the production tooling, the incline can also assist in removing excess abrasive particles from the dispensing surface of the production tooling since excess abrasive particles can slide off the dispensing surface of the production tooling towards the incoming end. The incline may be between zero degrees up to an angle where the abrasive particles begin to fall out of the cavities. The preferred incline will depend on the abrasive particle shape and the magnitude of the force (e.g., friction or vacuum) holding the abrasive particle in the cavity. In some embodiments, the positive incline is in a range of from +10 to +80 degrees, or from +10 to +60 degrees, or from +10 to +45 degrees.

Optionally, an abrasive particle removal member 121 can be provided to assist in removing the excess abrasive particles from the surface of the production tooling 200 once most or all of the cavities have been filled by an abrasive particle. The abrasive particle removal member can be, for example, a source of air to blow the excess abrasive particles off the dispensing surface of the production tooling such as an air wand, air shower, air knife, a conada effect nozzle, or a blower. A contacting device can be used as the abrasive particle removal member such as a brush, a scraper, a wiper, or a doctor blade. A vibrator, such as an ultrasonic horn, can be used as the abrasive particle removal member. Alternatively, a vacuum source such as vacuum box or vacuum roll located along a portion of the first web path after the abrasive particle feeder 118 with a production tool having cavities extending completely through the production tool can be used to hold the abrasive particles in the cavities. In this span or section of the first web path, the dispensing surface of the production tool can be inverted or have a large incline or decline approaching or exceeding 90 degrees to remove the excess abrasive particles using the force of gravity to slide or drop them from the dispensing surface while retaining the abrasive particles disposed in the cavities by vacuum until the dispensing surface is returned to an orientation to keep the abrasive particles in the cavities due to the force of gravity or they are released from the cavities onto the resin coated backing. In embodiments, where the abrasive particle is fully contained within the cavity of the production tooling, that is to say where the majority (e.g., 80, 90, or 95 percent) of the abrasive particles in the cavities do not extend past the dispensing surface of the tooling, the abrasive particle removal member 121 can slide the excess abrasive particles across the dispensing surface of the production tooling and off of the production tool without disturbing the abrasive particles contained within the cavities. The removed excess abrasive particles can be collected and returned to the abrasive particle feeder for reuse. The excess abrasive particles can alternatively be moved in a direction opposite to the direction of travel of the production tool past or towards the abrasive particle feeder where they may fill unoccupied cavities.

After leaving the abrasive particle filling and excess removal section of the apparatus generally illustrated at 140, the abrasive particles in the production tool 220 travel towards the resin coated backing 114. The elevation of the production tooling in this section is not particularly important as long as the abrasive particles are retained in the cavities and the production tool could continue to incline, decline, or travel horizontally. Choice of the positioning is often determined by existing space within the machine if retrofitting an existing abrasive maker. An abrasive particle transfer roll 122 is provided and the production tooling 220 often wraps at least a portion of the roll's circumference. In some embodiments, the production tool wraps between 30 to 180 degrees, or between 90 to 180 degrees of the outer circumference of the abrasive particle transfer roll. The resin coated backing 114 often also wraps at least a portion of the roll's circumference such that the abrasive particles in the cavities are transferred from the cavities to the resin coated backing as both traverse around the abrasive particle transfer roll 122 with the production tooling 220 located between the resin coated backing and the outer surface of the abrasive particle transfer roll with the dispensing surface of the production tooling facing and generally aligned with the resin coated first major surface of the backing. The resin coated backing often wraps a slightly smaller portion of the abrasive particle transfer roll than the production tooling. In some embodiments, the resin coated backing wraps between 40 to 170 degrees, or between 90 to 170 degrees of the outer circumference of the abrasive particle transfer roll. Preferably the speed of the dispensing surface and the speed of the resin layer of the resin coated backing are speed matched to each other within ±10 percent, ±5 percent, or ±1 percent, for example.

Various methods can be employed to transfer the abrasive particles from cavities of the production tool to the resin coated backing. In no particular order the various methods are:

1. Gravity assist where the production tooling and dispensing surface is inverted for a portion of its machine direction travel and the abrasive particles fall out of the cavities under the force of gravity onto the resin coated backing. Typically in this method, the production tooling has two lateral edge portions with standoff members 260 (FIG. 2) located on the dispensing surface 212 and that contact the resin coated backing at two opposed edges of the backing where resin has not been applied to hold the resin layer slightly above the dispensing surface of the production tooling as both wrap the abrasive particle transfer roll. Thus, there is a gap between the dispensing surface and the top surface of the resin layer on the resin coated backing so as to avoid transferring any resin to the dispensing surface of the production tooling. In one embodiment, the resin coated backing has two edge strips free of resin and a resin coated middle section while the dispensing surface can have two raised ribs extending in the longitudinal direction of the production tooling for contact with the resin free edges of the backing. In another embodiment, the abrasive particle transfer roll can have two raised ribs or rings on either end of the roll and a smaller diameter middle section with the production tooling contained within the smaller diameter middle section of the abrasive particle transfer roll as it wraps the abrasive particle transfer roll. The raised ribs or end rings on the abrasive particle transfer roll elevate the resin layer of the resin coated backing above the dispensing surface such that there is a gap between the two surfaces. Alternatively, raised posts distributed on the production tooling surface could be used to maintain the gap between the two surfaces.
2. Pushing assist where each cavity in the production tooling has two open ends such that the abrasive particle can reside in the cavity with a portion of the abrasive particle extending past the back surface 214 of the production tooling. With push assist the production tooling no longer needs to be inverted but it still may be inverted. As the production tooling wraps the abrasive particle transfer roll, the roll's outer surface engages with the abrasive particle in each cavity and pushes the abrasive particle out of the cavity and into the resin layer on the resin coated backing. In some embodiments, the outer surface of the abrasive particle transfer roll comprises a resilient compressible layer with hardness Shore A durometer of, for example, 20-70, applied to provide additional compliance as the abrasive particle pushes into the resin coated backing. In another embodiment of pushing assist, the back surface of the production tooling can be covered with a resilient compressible layer instead of or in addition to the resilient outer layer of the abrasive particle transfer roll.
3. Vibration assist where the abrasive particle transfer roll or production tooling is vibrated by a suitable source such as an ultrasonic device to shake the abrasive particles out of the cavities and onto the resin coated backing.

4. Pressure assist where each cavity in the production tooling has two open ends or the back surface 214 or the entire production tooling is suitably porous and the abrasive particle transfer roll has a plurality of apertures and an internal pressurized source of air. With pressure assist the production tooling no longer needs to be inverted but it still may be inverted. The abrasive particle transfer roll can also have movable internal dividers such that the pressurized air can be supplied to a specific arc segment or circumference of the roll to blow the abrasive particles out of the cavities and onto the resin coated backing at a specific location. In some embodiments, the abrasive particle transfer roll may also be provided with an internal source of vacuum without a corresponding pressurized region or in combination with the pressurized region typically prior to the pressurized region as the abrasive particle transfer roll rotates. The vacuum source or region can have movable dividers to direct it to a specific region or arc segment of the abrasive particle transfer roll. The vacuum can suck the abrasive particles firmly into the cavities as the production tooling wraps the abrasive particle transfer roll before subjecting the abrasive particles to the pressurized region of the abrasive particle transfer roll. This vacuum region can be used, for example, with an abrasive particle removal member to remove excess abrasive particles from the dispensing surface or may be used to simply ensure the abrasive particles do not leave the cavities before reaching a specific position along the outer circumference of the abrasive particles transfer roll.
5. The various above listed embodiments are not limited to individual usage and they can be mixed and matched as necessary to more efficiently transfer the abrasive particles from the cavities to the resin coated backing.

The abrasive particle transfer roll 122 precisely transfers and positions each abrasive particle onto the resin coated backing substantially reproducing the pattern of abrasive particles and their specific orientation as arranged in the production tooling. Thus, for the first time, a coated abrasive article can be produced at speeds of, for example, 5-15 ft/min (1.5-4.6 m/min), or more where the exact position and/or radial orientation of each abrasive particle put onto the resin coated backing can be precisely controlled! As shown in the Examples later, the grinding performance for the same abrasive particle weight in the abrasive layer for a coated abrasive article can be significantly increased over the prior art.

After separating from the abrasive particle transfer roll 122, the production tooling travels along the first web path 99 back towards the abrasive particle filling and excess removal section of the apparatus generally illustrated at 140 with the assistance of idler rolls 116 as necessary. An optional production tool cleaner 128 can be provided to remove stuck abrasive particles still residing in the cavities and/or to remove make coat resin 108 transferred to the dispensing surface 212. Choice of the production tool cleaner will depend on the configuration of the production tooling and could be either alone or in combination, an additional air blast, solvent or water spray, solvent or water bath, an ultrasonic horn, or an idler roll the production tooling wraps to use push assist to force the abrasive particles out of the cavities. Thereafter the endless production tooling 220 or belt advances to the abrasive particle filling and excess removal section 140 to be filled with new abrasive particles.

Various idler rolls 116 can be used to guide the abrasive particle coated backing 123 having a predetermined, reproducible, non-random pattern of abrasive particles on the first major surface that were applied by the abrasive particle transfer roll and held onto the first major surface by the make coat resin along the second web path 132 into an oven 124 for curing the make coat resin. Optionally, a second abrasive particle coater 126 can be provided to place additional abrasive particles, such as another type of abrasive particle or diluents, onto the make coat resin prior to the oven 124. The second abrasive particle coater 126 can be a drop coater, spray coater, or an electrostatic coater as known to those of skill in the art. Thereafter the cured backing 128 with abrasive particles can enter into an optional festoon 130 along the second web path prior to further processing such as the addition of a size coat, curing of the size coat, and other processing steps known to those of skill in the art of making coated abrasive articles.

Method of Making a Coated Abrasive Article

A coated abrasive article maker apparatus is generally illustrated at FIG. 1. The method generally involves the steps of filling at least some of the cavities in a production tool with two or more individual abrasive particles. Aligning a filled production tool and a resin coated backing for transfer of the abrasive particles to the resin coated backing. Transferring the abrasive particles from the cavities onto the resin coated backing and removing the production tool from the aligned position with the resin coated backing. Thereafter the resin layer is cured, a size coat is applied and cured and the coated abrasive article is converted to sheet, disk, or belt form by suitable converting equipment.

In other embodiments, a batch process can be used where a length of the production tooling can be filled with abrasive particles, aligned or positioned with a length of resin coated backing such that the resin layer of the backing faces the dispensing surface of the production tooling and thereafter the abrasive particles transferred from the cavities to the resign layer. The batch process can be practiced by hand or automated using robotic equipment.

In a specific embodiment, a method of making a patterned abrasive layer on a resin coated backing including the following steps. It is not required to perform all steps or perform them in a sequential order, but they can be performed in the order listed or additional steps performed in between.

A step can be providing a production tool having a dispensing surface with cavities spaced a predetermined distance from each other, each cavity having a width, W. As seen in FIG. 2, the cavities are spaced a predetermined distance from each other. If the cavities are not tapered, then the width, W, is the distance between the vertical cavities walls. If the cavities are tapered, then the width, W, is measured at a cavity depth from the dispensing surface equal to the shaped abrasive particle's length, L as seen in FIGS. 3-4.

Another step can be filling at least 30% of the cavities in the dispensing surface with two or more shaped abrasive particles in an individual cavity creating a multiplexed abrasive structure comprising two or more shaped abrasive particles in close proximity to each other. Preferably at least 30%, 40%, 50%, 60%, 70%, 80%, 90%, or 95% of the cavities in the surface of the production tool are filled with at least two shaped abrasive particles. Another step can be selecting shaped abrasive particles having a thickness, t, such that at least two shaped abrasive particles occupy a cavity in the production tool. Preferably at least 30%, 40%, 50%, 60%, 70%, 80%, 90%, or 95% of the cavities in the surface of the production tool are filled with at least two shaped abrasive particles. Another step can be selecting shaped abrasive particles having a thickness, t, and a length, l, wherein at a cavity depth from the dispensing surface equal to, l, the cavity width, W, is greater than or equal to 2t. Preferably at least 30%, 40%, 50%, 60%, 70%, 80%, 90%, or 95% of the cavities in the surface of the production tool are filled with at least two shaped abrasive particles.

A step can be supplying an excess of the shaped abrasive particles to the dispensing surface such that more shaped abrasive particles are provided than the number of cavities. An excess of shaped abrasive particles, meaning there are more shaped abrasive particles present per unit length of the production tool than cavities present, helps to ensure all cavities within the production tool are eventually filled with one or more shaped abrasive particle as the shaped abrasive particles pile onto the dispensing surface and are moved about either due to gravity or other mechanically applied forces to translate them into a cavity. Since the bearing area and spacing of the abrasive particles is often designed into the production tooling for the specific grinding application, it is desirable to not have too many unfilled cavities.

Another step can be filling the cavities in the dispensing surface with a shaped abrasive particles disposed in the cavity with at least some of the cavities containing two or more shaped abrasive particles. It is desirable to transfer the shaped abrasive particles onto the resin coated backing such that they stand up or are erectly applied. In various embodiments, at least 30, 40, 50, 60, 70, 80, 90, or 95 percent of the cavities in the dispensing surface contain two or more shaped abrasive particles.

Another step can comprise filling at least some of the cavities with a single shaped abrasive particle such that the production tool has at least some cavities filled with two or more shaped abrasive particles and at least some cavities filled with only a single shaped abrasive particle. In general the thickness of the shaped abrasive particles will vary with the thinner shaped abrasive particles forming the multiplexed abrasive structures and the thicker shaped abrasive particles selected such that only one particle is able to fit in a cavity. Another step can comprise filling at least some of the cavities with crushed abrasive particles such that the production tool has at least some cavities filled with two or more shaped abrasive particles and at least some cavities filled with crushed abrasive particles. Another step can comprise filling at least some of the cavities with a single shaped abrasive particle, at least some with crushed abrasive particles, and at least some with two or more shaped abrasive particles such that the production tool has at least some cavities filled with two or more shaped abrasive particles, at least some cavities filled with only a single shaped abrasive particle, and at least some cavities filled with crushed abrasive particles.

Another step can be removing a remaining fraction of the excess shaped abrasive particles not disposed within a cavity after the filling step from the dispensing surface. As mentioned, more shaped abrasive particles are supplied than cavities such that some will remain on the dispensing surface after each cavity has been filled. These excess shaped abrasive particles can often be blown, wiped, or otherwise removed from the dispensing surface. For example, a vacuum or other force could be applied to hold the shaped abrasive particles in the cavities and the dispensing surface inverted to clear it of the remaining fraction of the excess shaped abrasive particles.

Another step can be aligning the resin coated backing with the dispensing surface with the resin layer facing the dispensing surface. Various methods can be used to align the surfaces or position the resin coated backing and the production tooling such as the method shown in FIG. 1, or by hand or robots using discrete lengths of each.

Another step can be transferring the abrasive particles in the cavities to the resin coated backing and attaching the abrasive particles to the resin layer. Transferring can use gravity assist wherein the dispensing surface is positioned to allow the force of gravity to slide the abrasive particles into the cavities during the filling step and after the dispensing surface is inverted during the transferring step to allow the force of gravity to slide the abrasive particles out of the cavities. Transferring can use push assist where a contact member such as the outer circumference of the abrasive particle transfer roll, the optional compressible resilient layer attached to the back surface of the carrier layer of the production tool, or another device such as doctor blade or wiper in combination with cavities having an opening in the surface opposing the opening in the dispensing surface to move the shaped abrasive particles laterally along the longitudinal cavity axis for contact with the resin layer. Transferring can use pressure assist where air blows into the cavities; especially cavities having an opening in the surface opposing the opening in the dispensing surface to move the shaped abrasive particles laterally along the longitudinal cavity axis. Transferring can use vibration assist by vibrating the production tool to shake the shaped abrasive particles out of the cavities. These various methods may be used alone or in any combination.

Another step can be removing the production tool to expose the patterned abrasive layer on the resin coated backing. Various removing or separating methods can be used as shown in FIG. 1 or the production tool can be lifted by hand to separate it from the resin coated backing. The patterned abrasive layer which results is an array of the shaped abrasive particles having a substantially repeatable pattern as opposed to a random distribution created by electrostatic coating or drop coating.

In any of the above embodiments, a filling assist member as previously described can move the shaped abrasive particles around on the dispensing surface after the supplying step to direct the shaped abrasive particles into the cavities. In any of the previous embodiments, the cavities can taper inward when moving along the longitudinal cavity axis from the dispensing surface. In any of the previous embodiments, the cavities can have a cavity outer perimeter surrounding the longitudinal cavity axis and the shaped abrasive particles have an abrasive particle outer perimeter surrounding the longitudinal particle axis and the shape of the cavity outer perimeter matches the shape of the elongated abrasive particle outer perimeter. In any of the previous embodiments, the shaped abrasive particles can be equilateral triangles and the width of the shaped abrasive particles along the longitudinal particle axis is nominally the same. A nominal width of shaped abrasive particles means that the width dimension varies less than ±30 percent.

Production Tools and Abrasive Particle Positioning Systems

Abrasive particle positioning systems according to the present disclosure include abrasive particles removably disposed within shaped cavities of a production tool.

Referring now to FIG. 2, exemplary production tool 200 comprises carrier member 210 having dispensing and back surfaces 212, 214. Dispensing surface 212 comprises cavities 220 that extend into carrier member 210 from cavity openings 230 at the dispensing surface 212. Optional compressible resilient layer 240 is secured to back surface 214. Cavities 220 are disposed in an array 250, which can be optionally disposed with a primary axis 252 at offset angle α relative to longitudinal axis 202 (corresponding to the machine direction in the case or a belt or roll) of production tool 200.

Typically, the openings of the cavities at the dispensing surface of the carrier member are rectangular; however, this is not a requirement. The length, width, and depth of the cavities in the carrier member will generally be determined at least in part by the shape and size of the abrasive particles with which they are to be used. For example, if the abrasive particles are shaped as equilateral triangular plates, then the lengths of individual cavities should preferably be from 1.1-1.2 times the maximum length of a side of the abrasive particles, the widths of individual cavities are preferably from 2.0-5.0 times the thickness of the abrasive particles, and the respective depths of the cavities should preferably be 1.0 to 1.2 times the base to peak height of the abrasive particles if two or more abrasive particles are to be contained within each of the cavities.

Alternatively, for example, if the abrasive particles are shaped as equilateral triangular plates and the abrasive particles are to protrude from the cavities, then the lengths of individual cavities should be less than that of an edge of the abrasive particles, and/or the respective depths of the cavities should be less than that of the base to peak height of the abrasive particles. Similarly, the width of the cavities should be selected such that at least 30%, 40%, 50%, 60%, 70%, 80%, 90%, or 95% of the cavities contain at least two shaped abrasive particles within each of the cavities. In some embodiments, 2 to 10 shaped abrasive particles fit in the cavities. In other embodiments, 2 to 5 shaped abrasive particles fit in the cavities. In other embodiments, 2 to 3 shaped abrasive particles fit in the cavities.

Optional longitudinally-oriented standoff members 260 are disposed along opposite edges (e.g., using adhesive or other means) of dispensing surface 212. Variations in design of the standoff members height allow adjustment of distance between the cavity openings 230 and a substrate (e.g., a backing having a make coat precursor thereon) that is brought into contact with the production tool.

If present, the longitudinally-oriented standoff members 260 may have any height, width and/or spacing (preferably they have a height of from about 0.1 mm to about 1 mm, a width of from about 1 mm to about 50 mm, and a spacing of from about 7 to about 24 mm). Individual longitudinally-oriented standoff members may be, for example, continuous (e.g., a rib) or discontinuous (e.g., a segmented rib, or a series of posts). In the case, that the production tool comprises a web or belt, the longitudinally-oriented standoff members are typically parallel to the machine direction.

The function of offset angle α is to arrange the abrasive particles on the ultimate coated abrasive article in a pattern that will not cause grooves in a workpiece. The offset angle α may have any value from 0 to about 30 degrees, but preferably is in a range of from 1 to 5 degrees, more preferably from 1 to 3 degrees.

Suitable carrier members may be rigid or flexible, but preferably are sufficiently flexible to permit use of normal web handling devices such as rollers. Preferably, the carrier member comprises metal and/or organic polymer. Such organic polymers are preferably moldable, have low cost, and are reasonably durable when used in the abrasive particle deposition process of the present disclosure. Examples of organic polymers, which may be thermosetting and/or thermoplastic, that may be suitable for fabricating the carrier member include: polypropylene, polyethylene, vulcanized rubber, polycarbonates, polyamides, acrylonitrile-butadiene-styrene plastic (ABS), polyethylene terephthalate (PET), polybutylene terephthalate (PBT), polyimides, polyetheretherketone (PEEK), polyetherketone (PEK), and polyoxymethylene plastic (POM, acetal), poly(ether sulfone), poly(methyl methacrylate), polyurethanes, polyvinyl chloride, and combinations thereof.

The production tool can be in the form of, for example, an endless belt (e.g., endless belt 200 shown in FIG. 1A), a sheet, a continuous sheet or web, a coating roll, a sleeve mounted on a coating roll, or die. If the production tool is in the form of a belt, sheet, web, or sleeve, it will have a contacting surface and a non-contacting surface. If the production tool is in the form of a roll, it will have a contacting surface only. The topography of the abrasive article formed by the method will have the inverse of the pattern of the contacting surface of the production tool. The pattern of the contacting surface of the production tool will generally be characterized by a plurality of cavities or recesses. The opening of these cavities can have any shape, regular or irregular, such as, for example, a rectangle, semi-circle, circle, triangle, square, hexagon, or octagon. The walls of the cavities can be vertical or tapered. The pattern formed by the cavities can be arranged according to a specified plan or can be random. Desirably, the cavities can butt up against one another.

The carrier member can be made, for example, according to the following procedure. A master tool is first provided. The master tool is typically made from metal, e.g., nickel. The master tool can be fabricated by any conventional technique, such as, for example, engraving, hobbing, knurling, electroforming, diamond turning, or laser machining. If a pattern is desired on the surface of the production tool, the master tool should have the inverse of the pattern for the production tool on the surface thereof. The thermoplastic material can be embossed with the master tool to form the pattern. Embossing can be conducted while the thermoplastic material is in a flowable state. After being embossed, the thermoplastic material can be cooled to bring about solidification.

The carrier member may also be formed by embossing a pattern into an already formed polymer film softened by heating. In this case, the film thickness may be less than the cavity depth. This is advantageous in improving the flexibility of carriers having deep cavities.

The carrier member can also be made of a cured thermosetting resin. A production tool made of thermosetting material can be made according to the following procedure. An uncured thermosetting resin is applied to a master tool of the type described previously. While the uncured resin is on the surface of the master tool, it can be cured or polymerized by heating such that it will set to have the inverse shape of the pattern of the surface of the master tool. Then, the cured thermosetting resin is removed from the surface of the master tool. The production tool can be made of a cured radiation curable resin, such as, for example acrylated urethane oligomers. Radiation cured production tools are made in the same manner as production tools made of thermosetting resin, with the exception that curing is conducted by means of exposure to radiation (e.g., ultraviolet radiation).

The carrier member may have any thickness as long as it has sufficient depth to accommodate the abrasive particles and sufficient flexibility and durability for use in manufacturing processes. If the carrier member comprises an endless belt, then carrier member thicknesses of from about 0.5 to about 10 millimeters are typically useful; however, this is not a requirement.

The cavities may have any shape, and are typically selected depending on the specific application. Preferably, at least a portion (and more preferably a majority, or even all) of the cavities are shaped (i.e., individually intentionally engineered to have a specific shape and size), and more preferably are precisely-shaped. In some embodiments, the cavities have smooth walls and sharp angles formed by a molding process and having an inverse surface topography to that of a master tool (e.g., a diamond turned metal master tool roll) in contact with which it was formed. The cavities may be closed (i.e., having a closed bottom).

Preferably, at least some of the sidewalls taper inwardly from their respective cavity opening at the dispensing surface of the carrier member with increasing cavity depth, or the cavity opening at the back surface. More preferably, all of the sidewalls taper inwardly from the opening at the dispensing surface of the carrier member with increasing cavity depth (i.e., with increasing distance from the dispensing surface).

In some embodiments, at least some of the cavities comprise first, second, third, and fourth sidewalls. In such embodiments, the first, second, third, and fourth side walls may be consecutive and contiguous.

In embodiments in which the cavities have no bottom surface but do not extend through the carrier member to the back surface, the first and third walls may intersect at a line, while the second and fourth sidewalls do not contact each other.

Figure 3A:
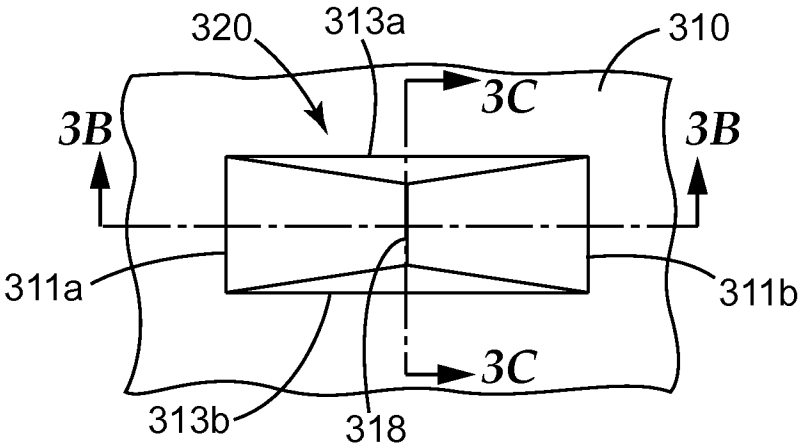
FIG. 3A is an enlarged schematic top view of an exemplary cavity 320 design suitable for use as cavities 220 in production tool 200
Figure 3C:
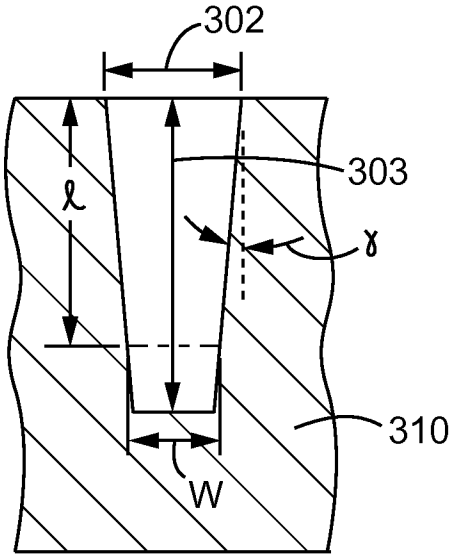
FIG. 3C is a cross-sectional view of FIG. 3A taken along plane 3C-3C
Figure 3B:
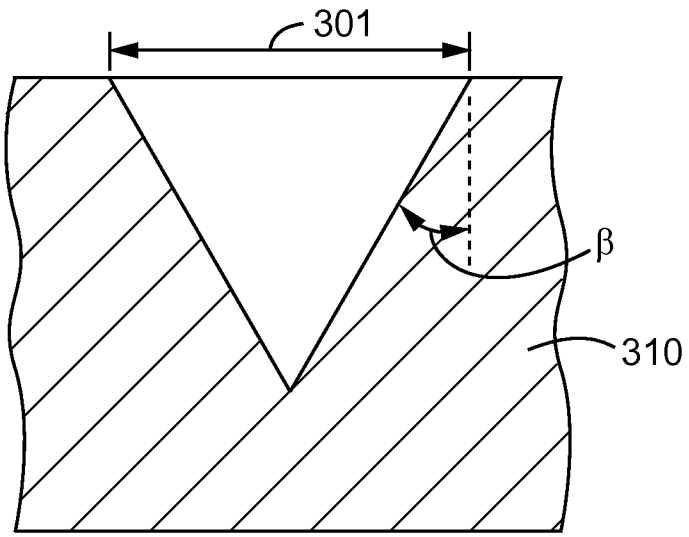
FIG. 3B is cross-sectional view of FIG. 3A taken along plane 3B-3B

One embodiment of a cavity of this type is shown in FIGS. 3A-3C. Referring now to FIGS. 3A-3C, exemplary cavity 320 in carrier member 310 has length 301 and dispensing surface width 302 (see FIG. 3A), and depth 303 (see FIG. 3B). Cavity 320 comprises four sidewalls 311*a*, 311*b*, 313*a*, 313*b*. Sidewalls 311*a*, 311*b* extend from openings 330 at dispensing surface 312 of carrier member 310 and taper inward at a taper angle β with increasing depth until they meet at line 318 (see FIG. 3B). Likewise, sidewalls 313*a*, 313*b* taper inwardly at a taper angle α with increasing depth until they contact line 318 (see FIGS. 3A and 3C).

Taper angles β and γ will typically depend on the specific abrasive particles selected for use with the production tool, preferably corresponding to the shape of the abrasive particles. In this embodiment, taper angle β may have any angle greater than 0 and less than 90 degrees. In some embodiments, taper angle β has a value in the range of 40 to 80 degrees, preferably 50 to 70 degrees, and more preferably 55 to 65 degrees. Taper angle γ will likewise typically depend on the generally be selected. In this embodiment, taper angle γ may have any angle in the range of from 0 and to 30 degrees. In some embodiments, taper angle γ has a value in the range of 5 to 20 degrees, preferably 5 to 15 degrees, and more preferably 8 to 12 degrees.

In some embodiments, the cavities are open at both the dispensing and the back surfaces. In some of these embodiments, the first and third sidewalls do not contact each other and the second and fourth sidewalls do not contact each other.

Figure 4A:
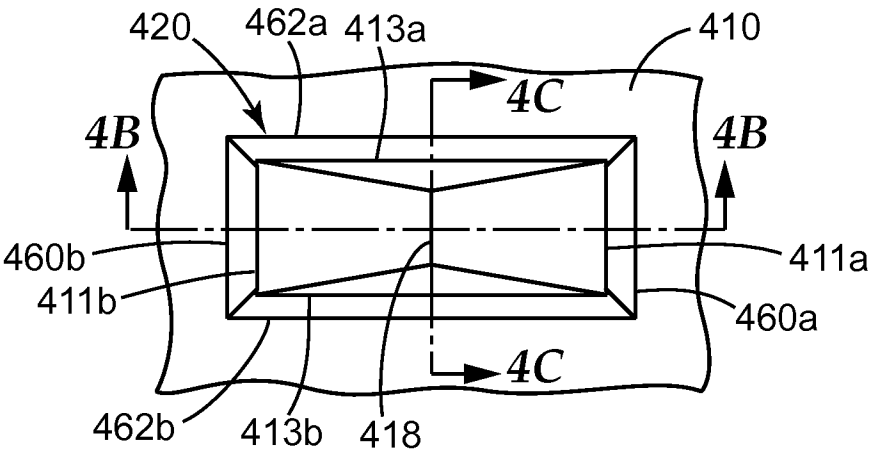
FIG. 4A is an enlarged schematic top view of an exemplary cavity 420 design suitable for use as cavities 220 in production tool 200
Figure 4C:
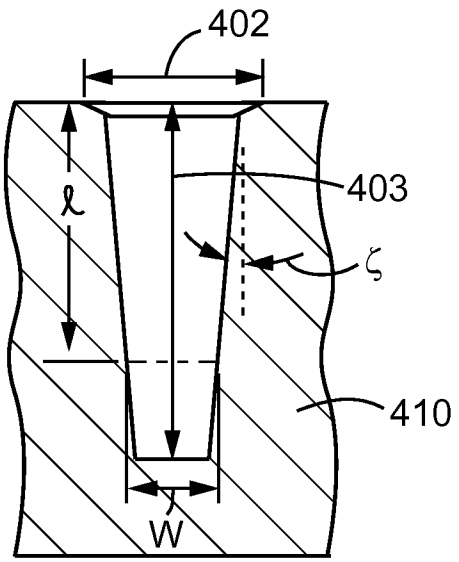
FIG. 4C is a schematic cross-sectional view of FIG. 4A taken along plane 4C-4C FIG. 5A are 3:1 aspect ratio shaped abrasive particles in a production tool
Figure 4B:
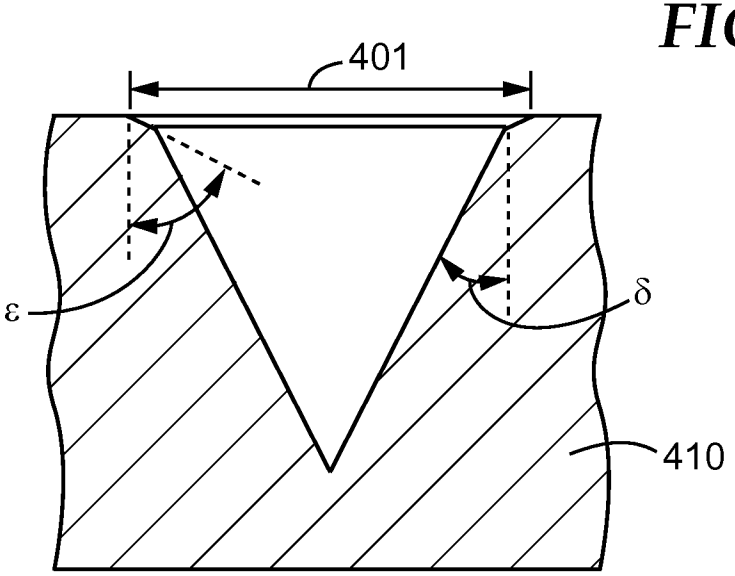
FIG. 4B is a schematic cross-sectional view of FIG. 4A taken along plane 4B-4B

FIGS. 4A-4B shows an alternative cavity 420 of similar type. Referring now to FIGS. 4A-4C, exemplary cavity 420 in carrier member 410 has length 401 and a dispensing surface width 402 (see FIG. 4A), and depth 403 (see FIG. 4B). Cavity 420 comprises four chamfers (460*a*, 460*b*, 462*a*, 462*b*) that contact dispensing surface 412 of carrier member 410 and four respective sidewalls 411*a*, 411*b*, 413*a*, 413*b*. Chamfers 460*a*, 460*b*, 462*a*, 462*b* each taper inward at a taper angle of δ (see FIG. 4B) and help guide abrasive particles into cavity 420. Sidewalls 411*a*, 411*b* extend from chamfers (460*a*, 460*b*) and taper inward at a taper angle ε with increasing depth until they meet at line 418 (see FIG. 4B). Sidewalls 413*a*, 413*b* likewise taper inwardly at a taper angle ζ with increasing depth until they contact line 418 (see FIGS. 4B and 4C).

Taper angle δ will typically depend on the specific abrasive particles selected for use with the production tool, preferably corresponding to the shape of the abrasive particles. In this embodiment, taper angle δ may have any angle greater than 0 and less than 90 degrees. Preferably, taper angle δ has a value in the range of 20 to 80 degrees, preferably 30 to 60 degrees, and more preferably 35 to 55 degrees Taper angle ε will typically depend on the specific abrasive particles selected for use with the production tool. In this embodiment, taper angle ε may have any angle greater than 0 and less than 90 degrees. In some embodiments, taper angle ε has a value in the range of 40 to 80 degrees, preferably 50 to 70 degrees, and more preferably 55 to 65 degrees.

Taper angle ζ will likewise typically depend on the specific abrasive particles selected for use with the production tool. In this embodiment, taper angle ζ may have any angle in the range of from 0 and to 30 degrees. In some embodiments, taper angle ζ has a value in the range of 5 to 25 degrees, preferably 5 to 20 degrees, and more preferably 10 to 20 degrees.

The cavities are positioned according to at least one of: a predetermined pattern such as, for example, an aligned pattern (e.g., an array), a circular pattern, a spiral pattern, an irregular but partially aligned pattern, or a pseudo-random pattern.

Preferably, the lengths and/or widths of the cavities narrow with increasing cavity depth, being largest at the cavity openings at the dispensing surface. The cavity dimensions and/or shapes are preferably chosen for use with a specific shape and/or size of abrasive particle. The cavities may comprise a combination of different shapes and/or sizes, for example. At least some of the cavity dimensions should be sufficient to accommodate and orient at least two shaped abrasive particles abrasive particles at least partially within the cavities. Preferably at least 30%, 40%, 50%, 60%, 70%, 80%, 90%, or 100% of the cavities are dimensioned such that at least two or more shaped abrasive particles reside within a cavity with the balance of the remaining cavities dimensioned to hold only a single shaped abrasive particle. Thus, for example, it's possible to have 50% of the cavities hold at least two shaped abrasive particles while the other 50% of the cavities hold only a single shaped abrasive particle.

In some embodiments, a majority or all of the abrasive particles are retained in the cavities such that less than about 20 percent (more preferably less than 10 percent, or even less than 5 percent) of their length extends past the openings of the cavities in which they reside. In some embodiments, a majority or all of the abrasive particles fully reside within (i.e., are completely retained within) the cavities and do not extend past their respective cavity openings at the dispensing surface of the carrier member.

In some embodiments, the cavities may be cylindrical or conical. This may particularly desirable if using crushed abrasive grain or octahedral shaped particles such as diamonds.

The cavities comprise at least one sidewall and may comprise at least one bottom surface; however, preferably the entire cavity shape is defined by the sidewalls and any openings at the dispensing and back surfaces. In some preferred embodiments, the cavities have at least 3, at least 4, at least 5, at least 6, at least 7, at least 8 sidewalls The sidewalls are preferably smooth, although this is not a requirement. The sidewalls may be planar, curviplanar (e.g., concave or convex), conical, or frustoconical, for example.

In some embodiments, at least some of the cavities comprise first, second, third, and fourth sidewalls. In such embodiments, the first, second, third, and fourth side walls may be consecutive and contiguous.

In embodiments in which the cavities have no bottom surface but do not extend through the carrier member to the back surface, the first and third walls may intersect at a line, while the second and fourth sidewalls do not contact each other.

In some embodiments, the cavities are open at both the first and the back surfaces. In some of these embodiments, the first and third sidewalls do not contact each other and the second and fourth sidewalls do not contact each other.

Preferably, at least some of the sidewalls taper inwardly from their respective cavity opening at the dispensing surface of the carrier member with increasing cavity depth, or the cavity opening at the back surface. More preferably, all of the sidewalls taper inwardly from the opening at the dispensing surface of the carrier member with increasing cavity depth (i.e., with increasing distance from the dispensing surface).

In some embodiments, at least one, at least two, at least 3, or even at least 4 of the sidewalls are convex.

In some embodiments, at least some of the cavities may independently comprise one or more chamfers disposed between the dispensing surface and any or all of the sidewalls. The chamfers may facilitate disposition of the abrasive particles within the cavities.

To avoid build up of the make coat precursor resin on the dispensing surface of the carrier member, at least two longitudinally-oriented (i.e., oriented substantially parallel to the machine direction of the carrier member/production tool in use) raised standoff members are preferably affixed to or integrally formed with the carrier. Preferably, at least two of the standoff members are disposed adjacent to the side edges along the length of the production tool. Examples of suitable standoff members that can be integrally formed with the carrier member include posts and ribs (continuous or segmented). Longitudinal orientation of the standoff members may be achieved by orientation of individual elongated raised standoff members such as ribs or tapes, or by patterns of low aspect raised stand of members such as, for example, an isolated row or other pattern of posts or other raised features.

Design and fabrication of carrier members, and of master tooling used in their manufacture, can be found in, for example, U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

To form an abrasive particle positioning system, abrasive particles are introduced into at least some cavities of a carrier member as described herein.

The abrasive particles can be disposed within the cavities of the carrier member using any suitable technique. Examples include dropping the abrasive particles onto the carrier member while it is oriented with the dispensing surface facing upward, and then agitating the particles sufficiently to cause them to fall into the cavities. Examples of suitable agitation methods may include, brushing, blowing, vibrating, applying a vacuum (for carrier members having cavities with openings at the back surface), and combinations thereof.

In typical use, abrasive particles are removably disposed within at least a portion, preferably at least 50, 60, 70, 80, 90 percent or even 100 percent of the cavities in the production tool. Preferably, abrasive particles are removably and completely disposed within at least some of the cavities, more preferably the abrasive particles are removably and completely disposed within at least 80 percent of the cavities. In some embodiments, the abrasive particles protrude from the cavities or reside completely within them, or a combination thereof.

The abrasive particles have sufficient hardness and surface roughness to function as abrasive particles in abrading processes. Preferably, the abrasive particles have a Mohs hardness of at least 4, at least 5, at least 6, at least 7, or even at least 8. Exemplary abrasive particles include crushed, shaped abrasive particles (e.g., shaped ceramic abrasive particles or shaped abrasive composite particles), and combinations thereof.

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles (e.g., including shaped and crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art.

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent to the binder.

Preferably, the abrasive particles comprise ceramic abrasive particles such as, for example, sol-gel-derived polycrystalline alpha alumina particles. The abrasive particles may be may be crushed or shaped, or a combination thereof.

Shaped ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Alpha alumina-based shaped ceramic abrasive particles can be made according to well-known multistep processes. Briefly, the method comprises the steps of making either a seeded or non-seeded sol-gel alpha alumina precursor dispersion that can be converted into alpha alumina; filling one or more mold cavities having the desired outer shape of the shaped abrasive particle with the sol-gel, drying the sol-gel to form precursor shaped ceramic abrasive particles; removing the precursor shaped ceramic abrasive particles from the mold cavities; calcining the precursor shaped ceramic abrasive particles to form calcined, precursor shaped ceramic abrasive particles, and then sintering the calcined, precursor shaped ceramic abrasive particles to form shaped ceramic abrasive particles. Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Although there is no particularly limitation on the shape of the shaped ceramic abrasive particles, the abrasive particles are preferably formed into a predetermined shape by shaping precursor particles comprising a ceramic precursor material (e.g., a boehmite sol-gel) using a mold, followed by sintering. The shaped ceramic abrasive particles may be shaped as, for example, pillars, pyramids, truncated pyramids (e.g., truncated triangular pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the shaped ceramic abrasive particles are precisely-shaped in that individual shaped ceramic abrasive particles will have a shape that is essentially the shape of the portion of the cavity of a mold or production tool in which the particle precursor was dried, prior to optional calcining and sintering.

Shaped ceramic abrasive particles used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant shaped ceramic abrasive particles have a respective nominal average shape that corresponds to the shape of cavities (e.g., truncated pyramid) in the tool surface; however, variations (e.g., random variations) from the nominal average shape may occur during manufacture, and shaped ceramic abrasive particles exhibiting such variations are included within the definition of shaped ceramic abrasive particles as used herein.

In some embodiments, the base and the top of the shaped ceramic abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to shaped ceramic abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

Preferably, the ceramic abrasive particles comprise shaped ceramic abrasive particles. Examples of sol-gel-derived shaped alpha alumina (i.e., ceramic) abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, sol-gel-derived shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

In some preferred embodiments, the abrasive particles comprise shaped ceramic abrasive particles (e.g., shaped sol-gel-derived polycrystalline alpha alumina particles) that are generally triangularly-shaped (e.g., a triangular prism or a truncated three-sided pyramid).

Shaped ceramic abrasive particles are typically selected to have a width in a range of from 0.1 micron to 3500 microns, more typically 100 microns to 3000 microns, and more typically 100 microns to 2600 microns, although other lengths may also be used.

Shaped ceramic abrasive particles are typically selected to have a thickness in a range of from 0.1 micron to 1600 microns, more typically from 1 micron to 1200 microns, although other thicknesses may be used.

In some embodiments, shaped ceramic abrasive particles may have an aspect ratio (length to thickness) of at least 2, 3, 4, 5, 6, or more.

Surface coatings on the shaped ceramic abrasive particles may be used to improve the adhesion between the shaped ceramic abrasive particles and a binder in abrasive articles, or can be used to aid in electrostatic deposition of the shaped ceramic abrasive particles. In one embodiment, surface coatings as described in U.S. Pat. No. 5,352,254 (Celikkaya) in an amount of 0.1 to 2 percent surface coating to shaped abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the shaped ceramic abrasive particles. Surface coatings to perform the above functions are known to those of skill in the art.

The abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

According to an embodiment of the present invention, the average diameter of the abrasive particles may be within a range of from 260 to 1400 microns in accordance with FEPA grades F60 to F24.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the abrasive particles pass through a test sieve meeting ASTM E-11 specifications for the number 18 sieve and are retained on a test sieve meeting ASTM E-11 specifications for the number 20 sieve. In one embodiment, the abrasive particles have a particle size such that most of the particles pass through an 18 mesh test sieve and can be retained on a 20, 25, 30, 35, 40, 45, or 50 mesh test sieve. In various embodiments, the abrasive particles can have a nominal screened grade of: −18+20, −20/+25, −25+30, −30+35, −35+40, 5−40+45, −45+50, −50+60, −60+70, −70/+80, −80+100, −100+120, −120+140, −140+170, −170+200, 200+230, −230+270, −270+325, −325+400, −400+450, −450+500, or −500+635. Alternatively, a custom mesh size can be used such as −90+100.

Coated Abrasive Article

Figure 10A:
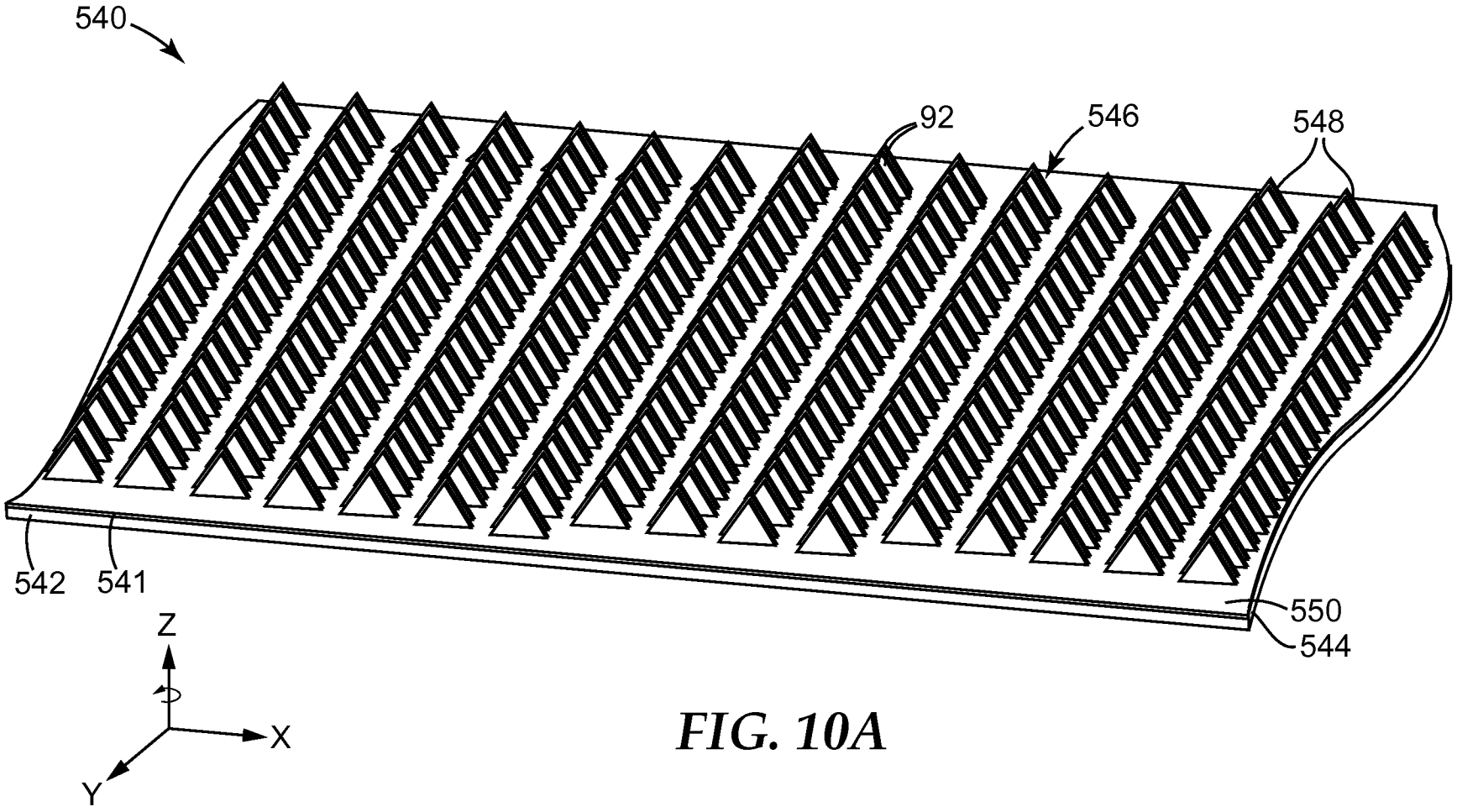
FIG. 10A is a drawing of a coated abrasive article made from the production tool of FIG. 2A having duplexed abrasive structures
Figure 10B:
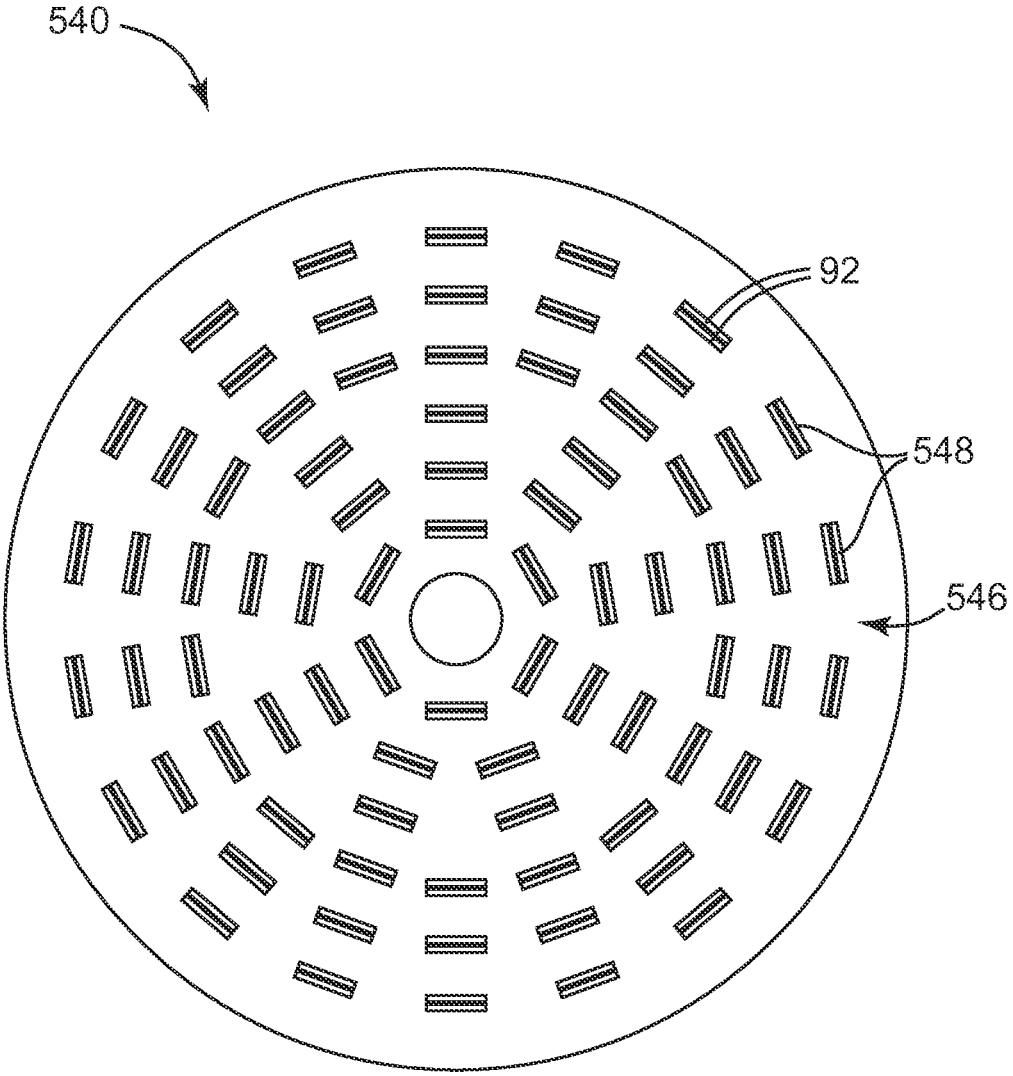
FIG. 10B is a drawing of a surface of a coated abrasive article having duplexed abrasive structures Repeated use of reference characters in the specification and drawings is intended to represent the same or analogous features or elements of the disclosure. It should be understood that numerous other modifications and embodiments can be devised by those skilled in the art which fall within the scope and spirit of the principles of the disclosure. The figures may not be drawn to scale.

Referring to FIGS. 10A and 10B, a coated abrasive article 540 comprises a backing 542 having a first layer of binder, hereinafter referred to as the make coat 544, applied over a first major surface 541 of backing 542. Attached or partially embedded in the make coat 544 are a plurality of shaped abrasive particles 92 forming a patterned abrasive layer 546. The patterned abrasive layer 546 comprises a plurality of multiplexed abrasive structures 548. Each multiplexed abrasive structure comprises two or more shaped abrasive particles 92 in close proximity to each other and having substantially the same rotational orientation about the Z axis. As seen, the multiplexed abrasive structures are spaced a predetermined distance in the X and Y directions from adjacent multiplexed abrasive structures forming the patterned abrasive layer.

Over the shaped abrasive particles 92 a second layer of binder, hereinafter referred to as the size coat 550 can be applied. The purpose of make coat 544 is to secure shaped abrasive particles 92 to backing 542 and the purpose of size coat 550 is to reinforce shaped abrasive particles 92.

The make coat 544 and size coat 550 comprise a resinous adhesive. The resinous adhesive of the make coat 544 can be the same as or different from that of the size coat 550. Examples of resinous adhesives that are suitable for these coats include phenolic resins, epoxy resins, urea-formaldehyde resins, acrylate resins, aminoplast resins, melamine resins, acrylated epoxy resins, urethane resins and combinations thereof. In addition to the resinous adhesive, the make coat 44 or size coat 46, or both coats, may further comprise additives that are known in the art, such as, for example, fillers, grinding aids, wetting agents, surfactants, dyes, pigments, coupling agents, adhesion promoters, and combinations thereof. Examples of fillers include calcium carbonate, silica, talc, clay, calcium metasilicate, dolomite, aluminum sulfate and combinations thereof.

A grinding aid can be applied to the coated abrasive article. A grinding aid is defined as particulate material, the addition of which has a significant effect on the chemical and physical processes of abrading, thereby resulting in improved performance. Grinding aids encompass a wide variety of different materials and can be inorganic or organic. Examples of chemical groups of grinding aids include waxes, organic halide compounds, halide salts, and metals and their alloys. The organic halide compounds will typically break down during abrading and release a halogen acid or a gaseous halide compound. Examples of such materials include chlorinated waxes, such as tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include tin, lead, bismuth, cobalt, antimony, cadmium, iron, and titanium. Other grinding aids include sulfur, organic sulfur compounds, graphite, and metallic sulfides. It is also within the scope of this invention to use a combination of different grinding aids; in some instances, this may produce a synergistic effect. In one embodiment, the grinding aid was cryolite or potassium tetrafluoroborate. The amount of such additives can be adjusted to give desired properties. It is also within the scope of this invention to utilize a supersize coating. The supersize coating typically contains a binder and a grinding aid. The binders can be formed from such materials as phenolic resins, acrylate resins, epoxy resins, urea-formaldehyde resins, melamine resins, urethane resins, and combinations thereof.

The multiplexed abrasive structures 548 or other abrasive particles forming the pattern in the patterned abrasive layer 546 can comprise parallel curvilinear lines, parallel linear lines, intersecting curvilinear lines, intersecting linear lines, concentric circles, spirals, or combinations thereof. The patterned abrasive layer can comprise multiplexed abrasive structures, multiplexed abrasive structures in combination with individual shaped abrasive particles, multiplexed abrasive structures in combination with crushed abrasive particles, or multiplexed abrasive structures in combination with individual shaped abrasive particles, and crushed abrasive particles.

EXAMPLES

Unless otherwise noted, all parts, percentages, ratios, etc. in the Examples and the rest of the specification are by weight.

To demonstrate the effects of this invention, equilateral, triangular shaped abrasive particles (FIG. 2) of three differing thickness were made and are designated by the aspect ratio of mold side length:mold thickness of the cavities in which they were formed. Aspect ratios of the cavities were 3:1, 5:1, and 6:1. Tool and particle dimensions are summarized in Table 1.

TABLE 1

| Aspect Ratio | Tool cavity side length, mm | Tool cavity depth, mm | SAP Side Length, mm | SAP Thickness, mm | FIG. # |
|---|---|---|---|---|---|
| 3:1 | 2.8 | 0.93 | 1.49 | 0.442 | 5A |
| 5:1 | 2.8 | 0.56 | 1.49 | 0.265 | 6A |
| 6:1 | 2.8 | 0.47 | 1.49 | 0.221 | 7A |

Abrasive Discs: Examples 3-8 and Controls 1 and 2

Shaped abrasive particles (SAP) were prepared according to the disclosure of U.S. Pat. No. 8,142,531. The shaped abrasive particles were prepared by molding alumina sol gel in equilateral triangle-shaped polypropylene mold cavities of side length 0.110 inch (2.8 mm) and a mold depth as described in Table 1. After drying and firing, the resulting shaped abrasive particles resembled FIG. 1A in U.S. Pat. No. 8,142,531 except that the draft angle α was approximately 98 degrees. The fired shaped abrasive particles were about 1.49 mm (side length)×the thickness described in Table 1 and would pass through a 20-mesh sieve.

A polypropylene transfer tooling was provided having vertically-oriented triangular openings as shown in FIGS. 1*a*, 1*b*, 1*c*, and 1*d* where s was 1.875 mm and t was 0.785 mm and d was 1.889 mm. The cavities had an 8 degree sidewall taper and the cavity width at the bottom of the cavity was 0.328 mm.

Figure 5A:
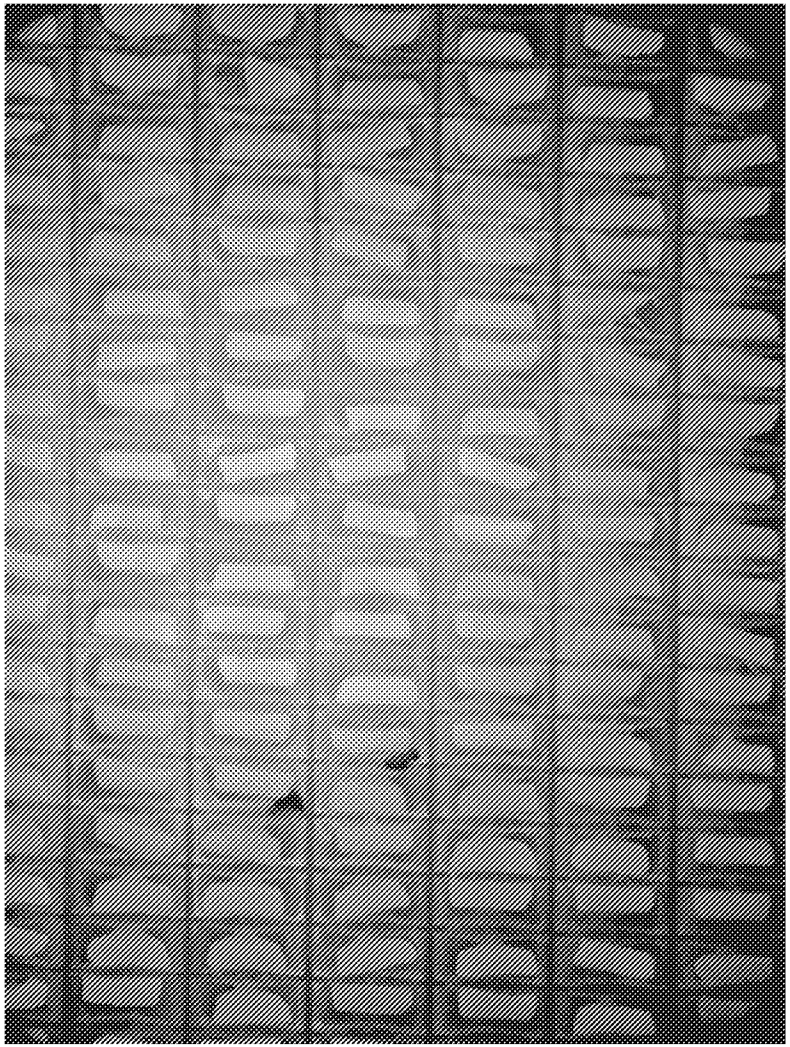
FIG. 5B is the abrasive surface of a coated abrasive article made from the tool in FIG. 5A (Example 1)
Figure 6A:
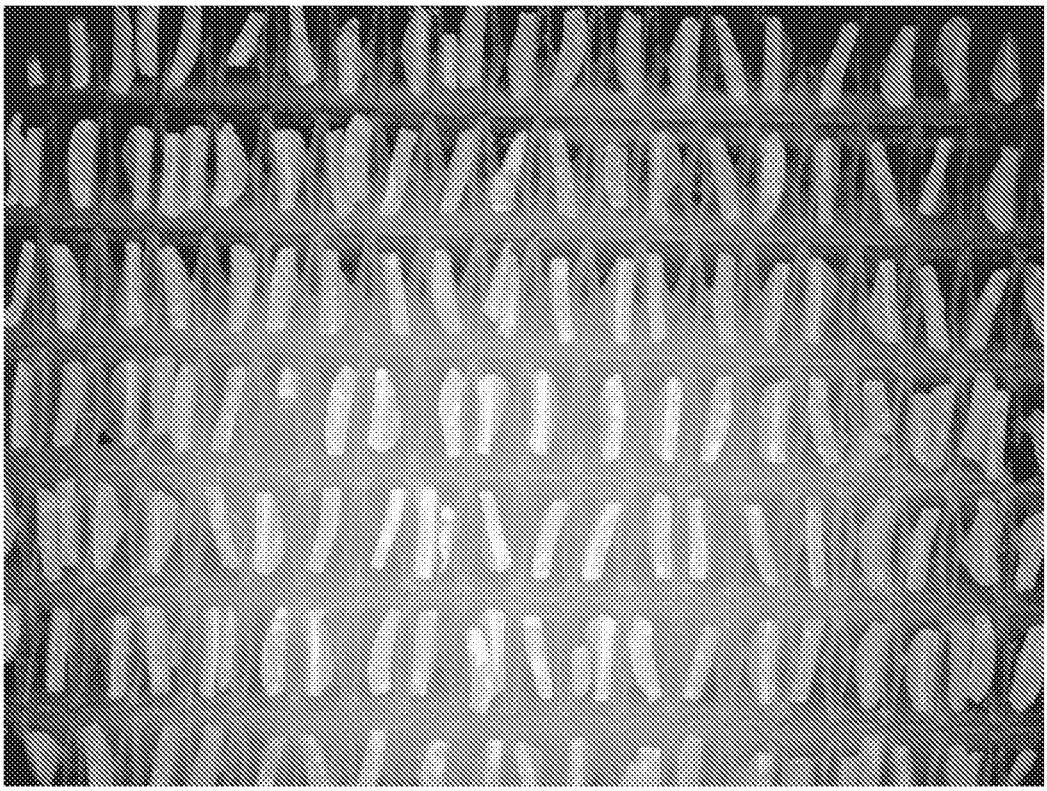
FIG. 6A are 5:1 aspect ratio shaped abrasive particles in a production tool
Figure 7A:
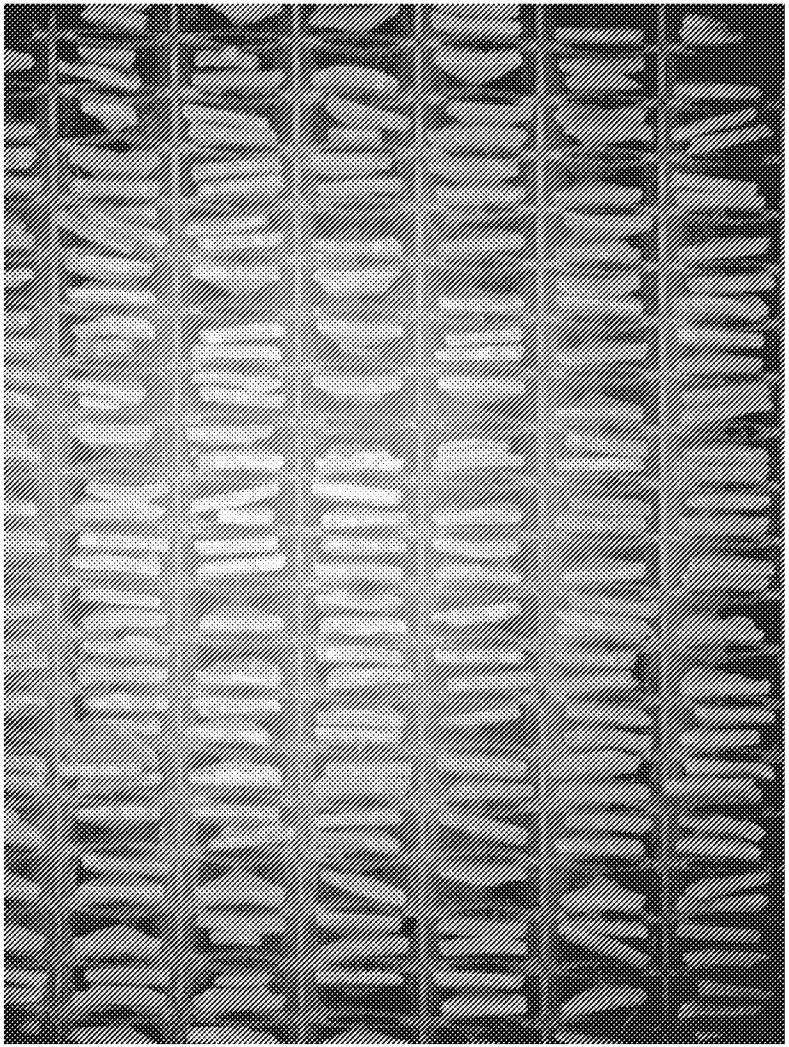
FIG. 7A are 6:1 aspect ratio shaped abrasive particles in a production tool

A square of the transfer tooling of sufficient size to make a 7 inch disc was affixed to a wooden board to keep it flat. A quantity of the shaped abrasive particles as described in Table 2 was applied to the surface of the transfer tooling and transfer tooling was vibrated side to side. The transfer tooling cavities were soon filled with shaped abrasive particles held vertex-down and base-up and oriented in the direction of the cavities' long dimension. Additional shaped abrasive particles were applied in this manner until greater than 95 percent of the apertures contained shaped abrasive particles. Excess grain not in the cavities was removed with a brush. FIGS. 5A, 6A, and 7A show the tooling filled with the various aspect ratio SAP.

A make resin was prepared by mixing 49 parts resole phenolic resin (based-catalyzed condensate from 1.5:1 to 2.1:1 molar ratio of phenol:formaldehyde), 41 parts calcium carbonate (HUBERCARB, Huber Engineered Materials, Quincy, Ill.) and 10 parts water. A quantity of make resin as described in Table 2 was then applied via a brush to a 7 in (17.8 cm) diameter×0.83 mm thick vulcanized fiber web (DYNOS VULCANIZED FIBRE, DYNOS GmbH, Troisdorf, Germany) having a 0.875 in (2.22 cm) center hole.

The shaped abrasive particle-filled transfer tooling was placed on a flat surface with the abrasive grain containing face up. The make resin-coated fiber disc was affixed to a flat board with transfer tape. The fiber disc assembly was placed over the filled transfer tooling and brought into contact. The assembly was held stationary and inverted. While holding the assembly stationary, the transfer tooling was tapped, releasing the shaped abrasive particles. The now substantially grain free transfer tooling was lifted vertically from the fibre disc. This resulted in the shaped abrasive particles being transferred to make resin with their vertexes up while largely maintaining the z-direction rotational orientation established by the transfer tooling's apertures. The weight and identification of the shaped abrasive particles transferred to the disc was as described in Table 2 for each example. The make resin was thermally cured (70 degrees for 45 minutes followed by 90 degrees C. for 45 minutes followed by 105 degrees C. for 3 hours). The disc was then coated with a conventional cryolite-containing phenolic size resin in an amount described in Table 2 and cured (70 degrees for 45 minutes followed by 90 degrees C. for 45 minutes followed by 16 hours at 105 degrees C.).

Figure 5B:
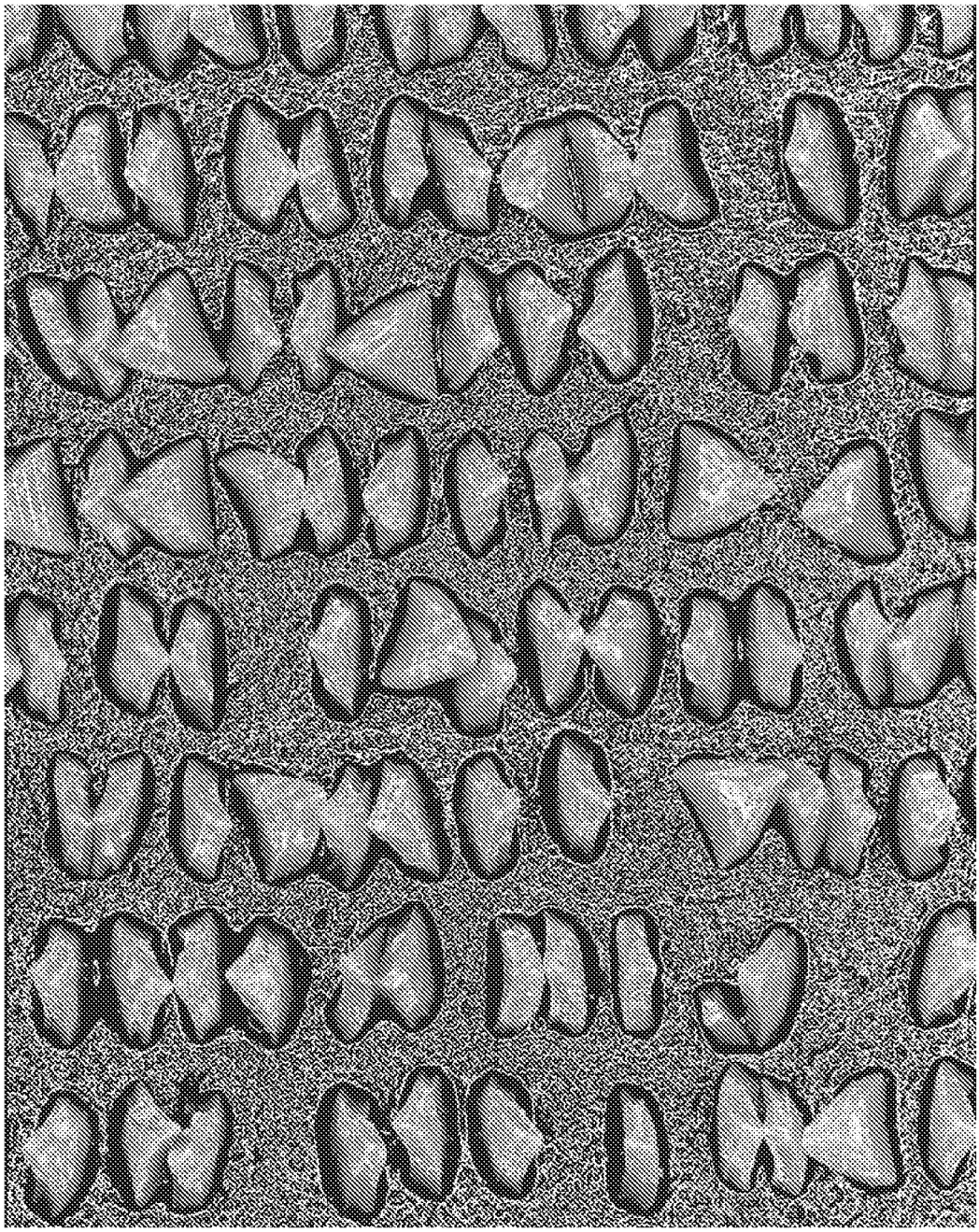
Figure 6B:
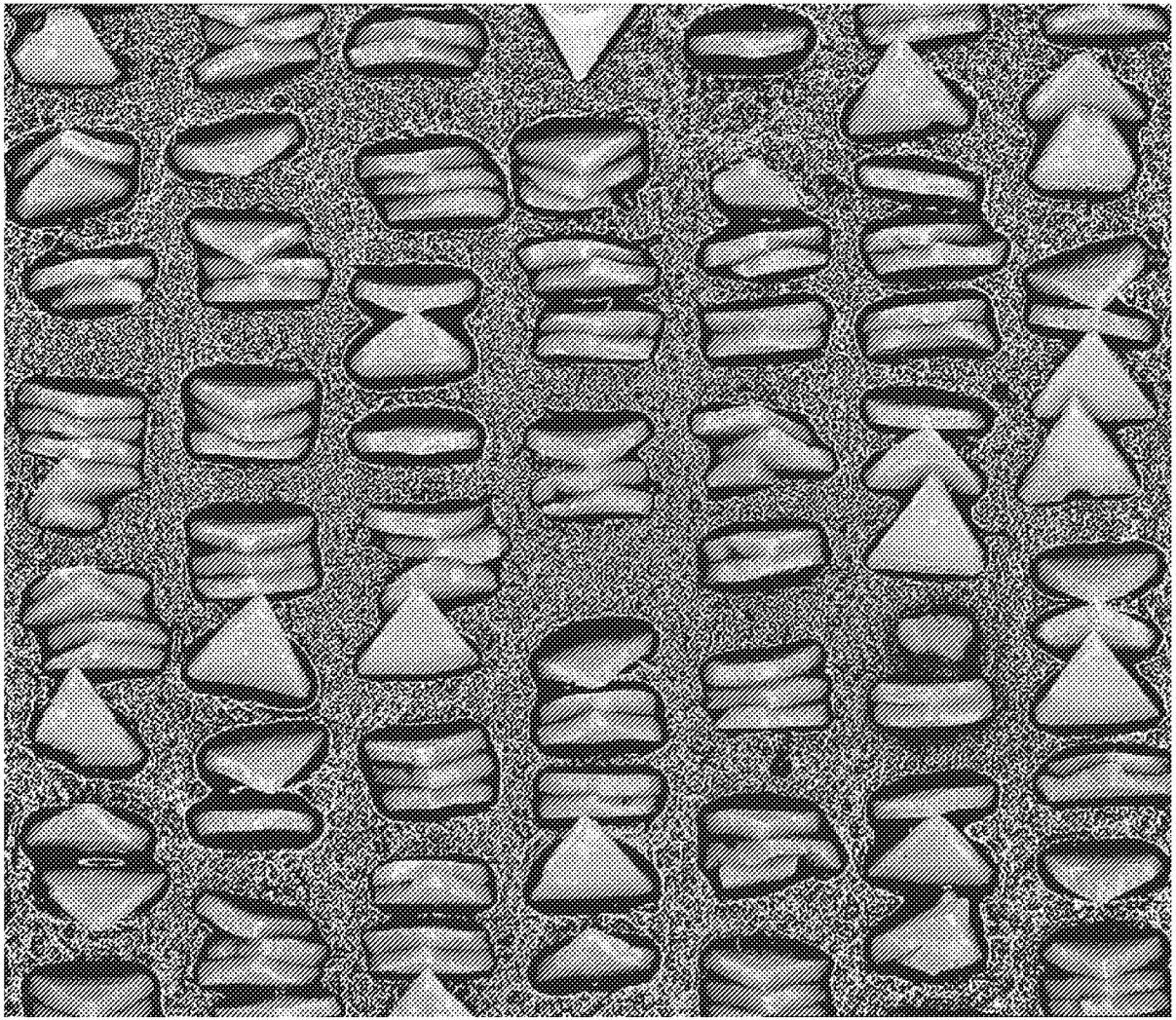
FIG. 6B is the abrasive surface of a coated abrasive article made from the tool in FIG. 6A (Example 3)
Figure 7B:
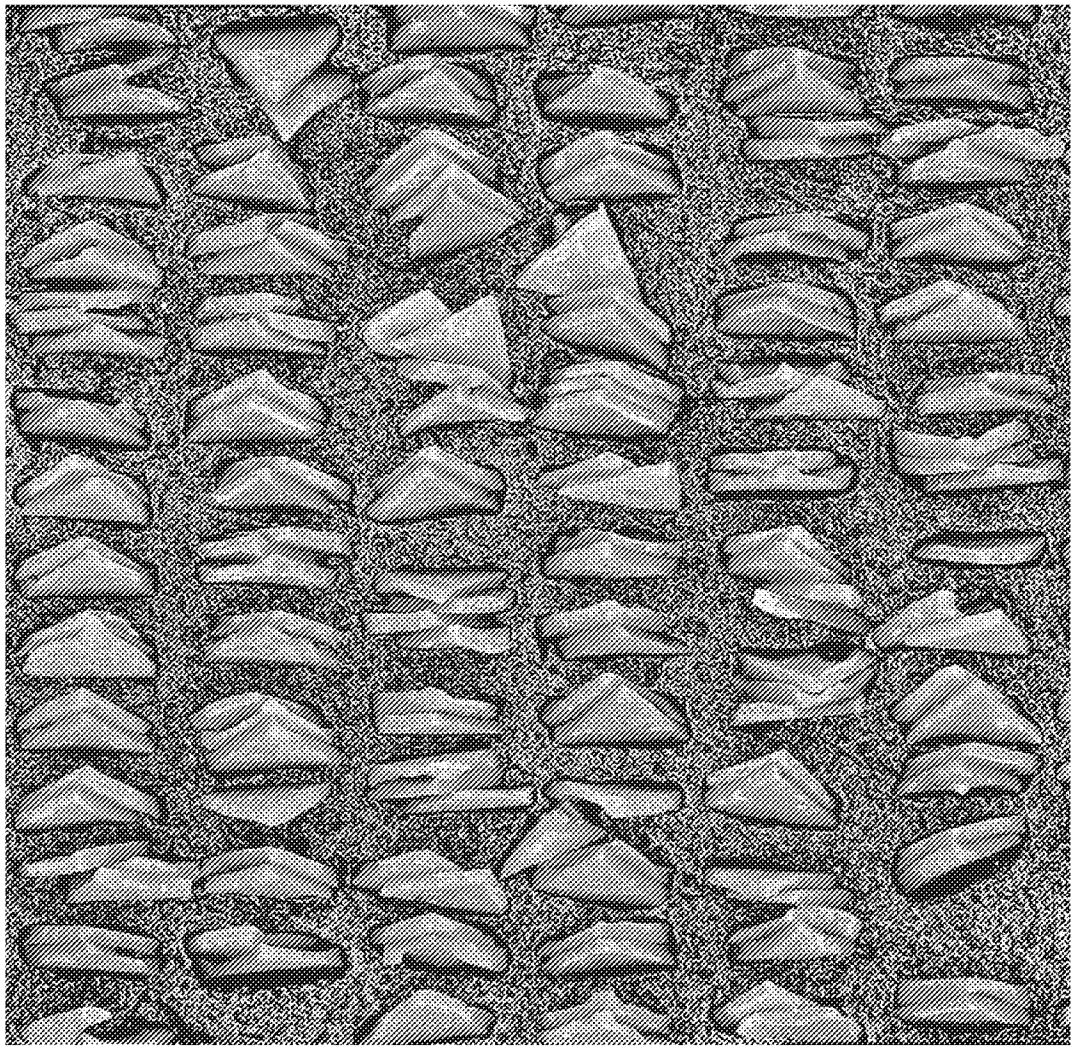
FIG. 7B is the abrasive surface of a coated abrasive article made from the tooling in FIG. 7A (Example 6)

The finished coated abrasive discs were allowed to equilibrate at ambient humidity for a week followed by 2 days at 50% RH before testing. FIGS. 5B, 6B, and 7B show the coated abrasive article made with the various aspect ratio shaped abrasive particles.

Comparative Examples A Through I

Comparative Examples A through I were prepared identically to Examples 1-8 except that the shaped abrasive particles were applied via electrostatic coating and therefore had a random orientation and alignment.

Grinding Test Method

The grinding performance of the various discs was evaluated by grinding 1045 cold rolled steel using the following procedure. Seven inch (17.8 cm) diameter abrasive discs for evaluation were attached to a rotary grinder fitted with a 7-inch (17.8 cm) disc pad face plate (051144-80514 red ribbed obtained from 3M Company, St. Paul, Minn.). The grinder was then activated and urged against an end face of a 0.75×0.75 in (1.9×1.9 cm) pre-weighed 1045 cold rolled steel bar under a load of 12 lb (5.4 kg). The resulting rotational speed of the grinder under this load and against this workpiece was 5000 rpm. The workpiece was abraded under these conditions for 12-second grinding intervals (passes). Following each 12-second interval, the workpiece was allowed to cool to room temperature and weighed to determine the cut of the abrasive operation. Test results were reported in Table 2 as the initial cut for each interval and the total cut removed. The test end point was determined when the cut fell to 15 g per cycle. If desired, the testing can be automated using suitable equipment.

Results

Figure 8:
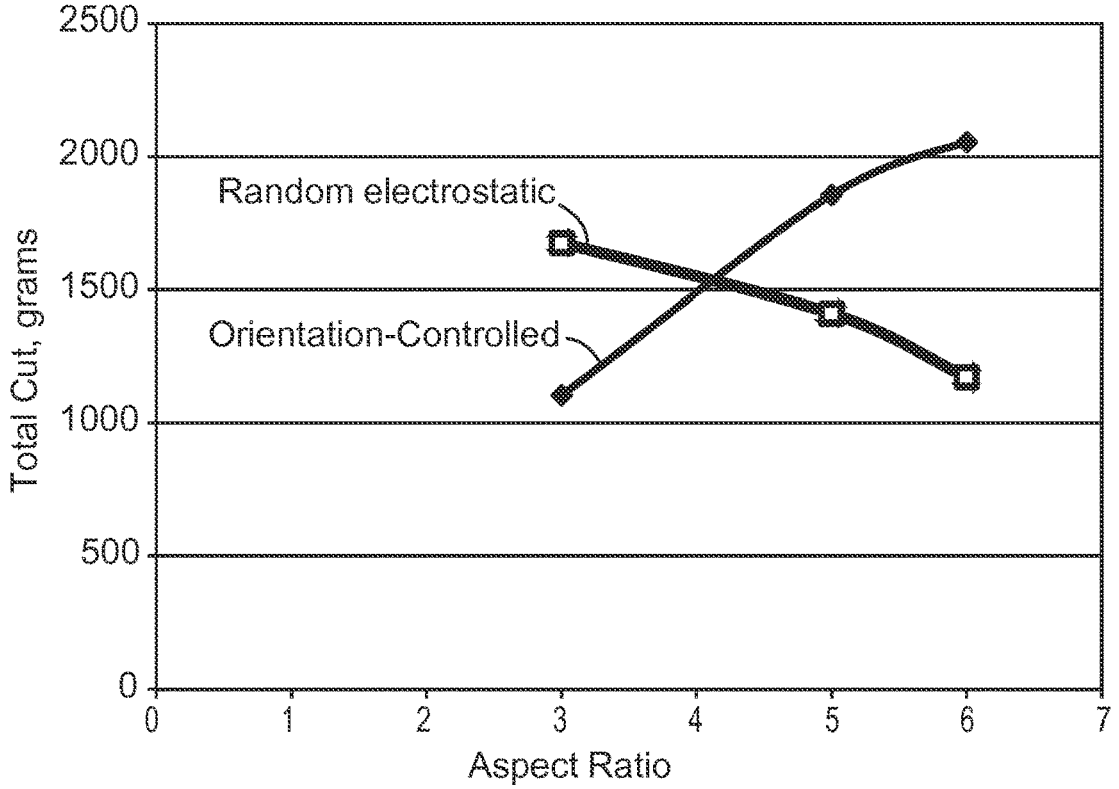
FIG. 8 is graphical representation of Total Cut v. Aspect Ratio for Examples, 1, 3, and 6

Table 2 shows the average number of shaped abrasive particles per tooling cavity and the grinding results. Grinding results are shown in FIG. 8. As seen when the aspect ratio of the SAP was greater than 3:1, meaning at least some of the cavities in the production tooling contained at least two particles, the results surpassed those achievable with electrostatic coating illustrating the superior grinding performance At the 5:1 aspect ratio the average number of SAPs per cavity was 1.4. At the 6:1 aspect ratio the average number of SAPs per cavity was 1.8. In both examples, a distribution of cavity filling was observed where the number of SAPS in a given cavity was 0, 1, 2 and for the 6:1 grain 3 or more.

TABLE 2

| Example | Process | Aspect Ratio | Make wt, g/m$^2$ | Mineral wt, g/m$^2$ | Size wt, g/m$^2$ | Initial Cut, g | Total Cut, g | % Cavities with ≥2 SAP (Avg. SAP/cavity) |
|---|---|---|---|---|---|---|---|---|
| Control 1 | transfer | 3:1 | 3.9 | 16.1 | 13.3 | 23.57 | 995 | 0 (1) (FIG. 5B) |
| Control 2 | transfer | 3:1 | 3.7 | 15.4 | 12.8 | 24.30 | 1214 | 0 (1) |
| 3 | transfer | 5:1 | 3.8 | 14.5 | 13.5 | 25.24 | 1710 | 40% (1.4) (FIG. 6B) |
| 4 | transfer | 5:1 | 3.6 | 14.8 | 13.6 | 24.46 | 2103 | 40% (1.4) |
| 5 | transfer | 5:1 | 3.8 | 13.8 | 12.8 | 26.76 | 1754 | 40% (1.4) |
| 6 | transfer | 6:1 | 3.6 | 14.6 | 16.8 | 35.22 | 2076 | 80% 1.8 (FIG. 7B) |
| 7 | transfer | 6:1 | 3.6 | 15.4 | 16.9 | 34.44 | 2129 | 80% 1.8 |
| 8 | transfer | 6:1 | 3.7 | 15.5 | 17.1 | 33.09 | 1961 | 80% 1.8 |
| Comp. A | e-coat | 3:1 | 3.6 | 15.6 | 12.8 | 22.96 | 1620 | na |
| Comp. B | e-coat | 3:1 | 3.5 | 16 | 12.9 | 23.87 | 1869 | na |
| Comp. C | e-coat | 3:1 | 3.9 | 15.9 | 12.6 | 24.24 | 1536 | na |
| Comp. D | e-coat | 5:1 | 3.8 | 14.3 | 13.6 | 21.05 | 1561 | na |
| Comp. E | e-coat | 5:1 | 3.9 | 14.3 | 13.6 | 21.26 | 1383 | na |
| Comp. F | e-coat | 5:1 | 3.9 | 14.7 | 13.5 | 20.21 | 1291 | na |
| Comp. G | e-coat | 6:1 | 3.8 | 14.6 | 17 | 25.34 | 450 | na |
| Comp. H | e-coat | 6:1 | 3.9 | 14.9 | 17.2 | 25.14 | 1214 | na |
| Comp. I | e-coat | 6:1 | 3.7 | 14.7 | 17.2 | 23.18 | 1132 | na |

Percent of cavities with two or more abrasive particles determined by weight percentage ignoring small number of cavities present with no abrasive particles after filling the tooling Examples 9-12 Abrasive Belts Example 9 (3:1)

Untreated polyester cloth having a weight of 300-400 grams per square meter (g/m2), obtained under the trade designation POWERSTRAIT from Milliken & Company, Spartanburg, S.C., was presized with a composition consisting of 75 parts EPON 828 epoxy resin (bisphenol A diglycidyl ether, from Resolution Performance Products, Houston, Tex.), 10 parts of trimethylolpropane triacrylate (obtained as SR351 from Cytec Industrial Inc., Woodland Park, N.J.), 8 parts of dicyandiamide curing agent (obtained as DICYANEX 1400B from Air Products and Chemicals, Allentown, Pa.), 5 parts of novolac resin (obtained as RUTAPHEN 8656 from Momentive Specialty Chemicals Inc., Columbus, Ohio), 1 part of 2,2-dimethoxy-2-phenylacetophenone (obtained as IRGACURE 651 photoinitiator from BASF Corp., Florham Park, N.J.), and 0.75 part of 2-propylimidazole (obtained as ACTIRON NXJ-60 LIQUID from Synthron, Morganton, N.C.). A 10.16 cm×114.3 cm strip of this backing was taped to a 15.2 cm×121.9 cm×1.9 cm thick laminated particle board. The cloth backing was coated with 183 g/m2 of phenolic make resin consisting of 52 parts of resole phenolic resin (obtained as GP 8339 R23155B from Georgia Pacific Chemicals, Atlanta, Ga.), 45 parts of calcium metasilicate (obtained as WOLLASTOCOAT from NYCO Company, Willsboro, N.Y.), and 2.5 parts of water using a putty knife to fill the backing weave and remove excess resin.

The SAP (870 g/m$^2$) (shaped abrasive particles prepared according to the disclosure of U.S. Pat. No. 8,142,531 (Adefris et al.) having nominal equal side lengths and thickness as described in Table 1 for 3:1 aspect ratio grain and a sidewall angle of 98 degrees) were filled into a 6.35×10.16 cm production tool with vertically-oriented triangular openings (2.0 mm×0.93 mm×1.47 mm deep with a 5.0 degree sidewall taper (FIG. 3), with their long dimensions aligned 5.0 degrees off parallel to the long dimension of the backing, using vibration and a brush to remove excess mineral. Eleven such tools were lined up long end to long end and mounted to a second 15.2 cm×121.9 cm×1.9 cm thick particle board to ensure that at least a 111 cm strip of abrasive coating was generated. A 1.0 cm diameter hole was drilled through the thickness at the midpoint of the 15.2 cm dimension and approximately 2.54 cm from each end of both of the laminated particle boards. A base was constructed that had a 0.95-cm diameter vertical dowels at each end to engage the holes in the particle boards and thereby align the placement of first the abrasive particle filled tooling (open side up), followed by the make resin-coated backing (coated side down). Several spring clamps were attached to the particle boards to hold the construction together. The clamped assembly was removed from the dowels, flipped over (backing now coated side up and tooling open side down) and placed back onto the base using the dowels to maintain alignment. The back of the laminated particle board was repeatedly tapped lightly with a hammer to transfer 870 g/m$^2$ of the abrasive particles to the make-coated backing. The spring clamps were removed and the top board carefully removed from the dowels so the transferred mineral was not knocked over on its side.

The tape was removed and the abrasive coated backing and it was placed in an oven at 90° C. for 1.5 hours to partially cure the make resin. A size resin (756 g/m$^2$) consisting of 29.42 parts of resole phenolic resin (obtained as GP 8339 R-23155B from Georgia Pacific Chemicals, Atlanta, Ga.), 18.12 parts of water, 50.65 parts of cryolite (obtained as RTN Cryolite from TR International Trading Co., Houston, Tex.), 59 parts of grade 40 FRPL brown aluminum oxide (obtained from Treibacher Schleifmittel AG, Villach, Austria) and 1.81 parts of surfactant (obtained as EMULON A from BASF Corp., Mount Olive, N.J.) was brushed on, and the coated strip was placed in an oven at 90° C. for 1 hour, followed by and 8 hour cure at 102° C. A supersize coating was then applied over the size coat. The supersize was applied as a 72% solids solution in water. The supersize coating comprised 17 parts of epoxy resin CMD35201 (HiTek Polymers, Jeffersontown, Ky.), 76 parts potassium tetrafluoroborate grinding aid, 2 parts red iron oxide KR3097 (Harcros Pigments, Inc, E. Saint Louis, Ill.), and 2 parts of a 25 wt % solution of 2-ethyl-4-methyl imidazole in water (EMI-24 from Air Products and Chemicals, Allentown, Pa. The supersize was applied at a wet coating weight of about 500 g/m$^2$. The resulting construction was first cured for 30 minutes at 90° C. followed by a final cure for 1 hours at 108° C. After cure, the strip of coated abrasive was converted into a belt using conventional adhesive splicing practices.

Example 10

Example 15 was a replicate of Example 14 except that the mineral weight was 910 g/m$^2$.

Example 11

Example 16 was prepared identically to Example 14 except that the abrasive particle aspect ratio was 6:1, had dimensions as described in Table 1 and the coat weight was 740 g/m$^2$.

Example 12

Example 17 was a replicate of Example 16 with a mineral coat weight of 760 g/m$^2$.

Abrasive Belt Test

The Abrasive Belt Test was used to evaluate the efficacy of inventive abrasive belts. Test belts were of dimension 10.16 cm×91.44 cm. The workpiece was a 304 stainless steel bar that was presented to the abrasive belt along its 1.9 cm×1.9 cm end. A 20.3 cm diameter, 70 durometer Shore A, serrated (1:1 land to groove ratio) rubber contact wheel was used. The belt was driven to 5500 SFM (28 m/sec.). The workpiece was urged against the center part of the belt at a blend of normal forces from 10 to 15 pounds (4.53 to 6.8 kg). The test consisted of measuring the weight loss of the workpiece after 15 seconds of grinding (1 cycle) and measuring the workpiece surface temperature with an optical pyrometer. The workpiece was then cooled and tested again. The test was concluded after 60 test cycles. The cut in grams was recorded after each cycle.

Results

Figure 9:
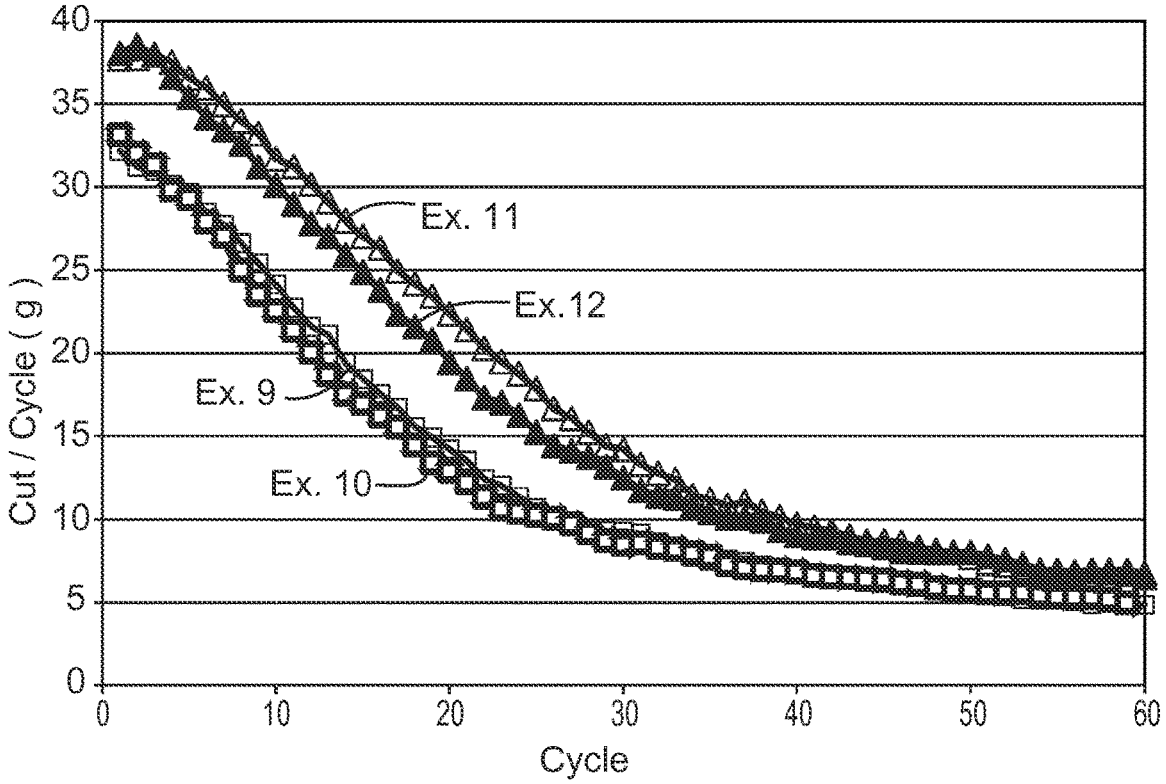
FIG. 9 is a plot of Cut v. Cycle for the results for Examples 9-12

The test results are reported in Table 3 wherein "wp temp" means workpiece temperature. They are also plotted graphically in FIG. 9. As seen in FIG. 9, Examples 11 and 12 made from SAP having an aspect ratio of 6:1 such that more than one SAP could fit into a cavity in the tooling as shown in FIG. 7A (approximately 80% of the cavities field with two or more SAP) had superior grinding results as compared to Examples 9 and 10 made from SAP having an aspect ratio of 3:1 such that only one SAP could fit into a cavity in the tooling as shown in FIG. 5A.

TABLE 3

| | Ex. 9 | | Ex. 10 | | Ex. 11 | | Ex. 12 | |
|---|---|---|---|---|---|---|---|---|
| Cycle | cut, g | wp temp, ° C. | cut, g | wp temp, ° C. | cut, g | wp temp, ° C. | cut, g | wp temp, ° C. |
| 1 | 32.15 | 41.6 | 33.14 | 40.6 | 37.69 | 34.8 | 38.05 | 35.5 |
| 2 | 31.20 | 46.2 | 32.00 | 43.7 | 37.73 | 37.7 | 38.53 | 37.2 |
| 3 | 30.97 | 47.9 | 31.34 | 45.2 | 37.98 | 37.9 | 37.95 | 38.8 |
| 4 | 30.11 | 48.8 | 29.79 | 53.8 | 37.51 | 38.7 | 36.62 | 40.3 |
| 5 | 29.61 | 51.2 | 29.28 | 56.7 | 36.56 | 41.3 | 35.41 | 41.6 |
| 6 | 28.43 | 51.7 | 27.92 | 55.7 | 35.96 | 40.3 | 34.15 | 43.2 |
| 7 | 27.70 | 56.1 | 27.05 | 58.9 | 34.97 | 42.2 | 33.42 | 48.2 |
| 8 | 26.64 | 56.4 | 25.02 | 55.0 | 33.96 | 43.2 | 32.58 | 49.4 |
| 9 | 25.43 | 58.7 | 23.54 | 58.6 | 33.19 | 46.0 | 31.20 | 52.2 |
| 10 | 24.14 | 57.5 | 22.58 | 59.1 | 31.67 | 45.8 | 30.08 | 45.9 |
| 11 | 22.74 | 61.1 | 21.36 | 61.2 | 31.22 | 49.0 | 28.94 | 48.6 |
| 12 | 21.60 | 63.1 | 20.06 | 67.0 | 30.15 | 50.1 | 27.82 | 52.5 |
| 13 | 21.11 | 65.6 | 18.69 | 66.8 | 29.08 | 50.9 | 27.04 | 54.2 |
| 14 | 19.39 | 65.0 | 17.53 | 69.7 | 27.96 | 52.6 | 25.93 | 55.7 |
| 15 | 18.43 | 68.6 | 16.97 | 71.2 | 27.03 | 54.3 | 24.90 | 59.3 |
| 16 | 17.56 | 70.1 | 16.22 | 71.3 | 26.34 | 55.6 | 23.81 | 61.0 |
| 17 | 16.70 | 72.3 | 15.55 | 73.1 | 24.96 | 58.6 | 22.35 | 63.3 |
| 18 | 15.56 | 72.4 | 14.45 | 71.5 | 24.17 | 58.8 | 21.61 | 64.8 |
| 19 | 14.91 | 72.4 | 13.40 | 77.1 | 23.44 | 60.9 | 20.81 | 67.1 |
| 20 | 14.19 | 77.1 | 12.88 | 76.8 | 22.37 | 65.1 | 19.44 | 70.2 |
| 21 | 13.52 | 77.7 | 12.20 | 79.7 | 21.42 | 64.5 | 18.46 | 70.7 |
| 22 | 12.40 | 78.5 | 11.34 | 82.1 | 20.29 | 65.4 | 17.31 | 72.1 |
| 23 | 12.01 | 78.4 | 10.63 | 83.3 | 19.48 | 68.7 | 17.02 | 73.9 |
| 24 | 11.33 | 84.1 | 10.45 | 83.7 | 18.74 | 71.1 | 16.25 | 73.6 |
| 25 | 10.67 | 86.6 | 10.28 | 84.0 | 17.85 | 70.5 | 15.24 | 77.6 |
| 26 | 10.20 | 84.4 | 10.09 | 84.8 | 16.65 | 73.6 | 14.42 | 75.7 |
| 27 | 9.78 | 88.8 | 9.75 | 87.8 | 16.06 | 75.8 | 14.10 | 77.6 |
| 28 | 9.50 | 93.1 | 9.21 | 89.3 | 15.22 | 75.1 | 13.73 | 78.6 |
| 29 | 9.29 | 92.1 | 8.73 | 89.9 | 14.39 | 78.3 | 13.15 | 80.8 |
| 30 | 9.28 | 94.8 | 8.50 | 93.2 | 14.20 | 78.4 | 12.47 | 80.9 |
| 31 | 9.15 | 97.3 | 8.59 | 94.4 | 13.28 | 79.6 | 11.73 | 81.9 |
| 32 | 8.62 | 95.7 | 8.33 | 91.9 | 12.75 | 79.7 | 11.41 | 86.7 |
| 33 | 8.28 | 96.6 | 8.21 | 95.4 | 12.38 | 82.0 | 11.31 | 85.0 |
| 34 | 7.77 | 96.8 | 7.99 | 98.3 | 11.40 | 83.4 | 10.85 | 84.4 |
| 35 | 7.52 | 100.8 | 7.77 | 97.3 | 11.17 | 87.2 | 10.44 | 87.1 |

TABLE 3-continued

| | Ex. 9 | | Ex. 10 | | Ex. 11 | | Ex. 12 | |
|---|---|---|---|---|---|---|---|---|
| Cycle | cut, g | wp temp, ° C. | cut, g | wp temp, ° C. | cut, g | wp temp, ° C. | cut, g | wp temp, ° C. |
| 36 | 7.57 | 97.8 | 7.30 | 100.2 | 10.81 | 85.2 | 10.11 | 88.0 |
| 37 | 7.43 | 106.8 | 7.09 | 102.6 | 11.03 | 87.1 | 10.11 | 93.2 |
| 38 | 7.21 | 108.3 | 7.00 | 101.4 | 10.45 | 87.1 | 9.92 | 91.8 |
| 39 | 6.91 | 108.2 | 6.96 | 106.0 | 10.13 | 87.3 | 9.35 | 92.9 |
| 40 | 6.79 | 111.1 | 6.84 | 108.2 | 9.71 | 89.3 | 9.05 | 94.8 |
| 41 | 6.71 | 110.4 | 6.62 | 104.7 | 9.52 | 88.1 | 8.90 | 92.4 |
| 42 | 6.56 | 107.6 | 6.54 | 97.1 | 9.30 | 90.8 | 8.91 | 94.4 |
| 43 | 6.40 | 112.9 | 6.49 | 102.3 | 9.00 | 93.3 | 8.63 | 94.6 |
| 44 | 6.31 | 114.4 | 6.40 | 109.5 | 8.70 | 96.4 | 8.51 | 97.1 |
| 45 | 6.18 | 107.2 | 6.38 | 105.1 | 8.72 | 95.6 | 8.30 | 95.9 |
| 46 | 6.19 | 110.2 | 6.18 | 108.1 | 8.63 | 96.1 | 8.11 | 89.5 |
| 47 | 6.01 | 112.3 | 6.12 | 110.9 | 8.32 | 98.9 | 8.08 | 91.2 |
| 48 | 5.93 | 114.3 | 5.89 | 108.8 | 8.14 | 98.7 | 8.03 | 94.1 |
| 49 | 5.77 | 113.4 | 5.78 | 110.2 | 8.02 | 104.0 | 8.02 | 93.4 |
| 50 | 5.62 | 116.6 | 5.74 | 108.4 | 7.73 | 98.0 | 8.01 | 93.6 |
| 51 | 5.49 | 118.7 | 5.57 | 113.4 | 7.37 | 100.4 | 7.80 | 95.1 |
| 52 | 5.38 | 122.0 | 5.58 | 112.3 | 7.23 | 107.8 | 7.57 | 97.6 |
| 53 | 5.22 | 119.8 | 5.59 | 113.9 | 7.08 | 105.6 | 7.33 | 98.6 |
| 54 | 5.17 | 124.8 | 5.41 | 108.5 | 6.91 | 105.3 | 6.95 | 100.7 |
| 55 | 5.22 | 125.7 | 5.34 | 114.5 | 6.87 | 108.4 | 6.93 | 101.6 |
| 56 | 5.11 | 123.2 | 5.32 | 116.9 | 6.84 | 105.0 | 6.85 | 99.8 |
| 57 | 4.93 | 122.4 | 5.30 | 111.9 | 6.88 | 104.2 | 6.95 | 102.1 |
| 58 | 4.97 | 119.0 | 5.22 | 111.9 | 6.95 | 106.2 | 6.81 | 101.4 |
| 59 | 4.90 | 122.4 | 4.97 | 114.3 | 6.93 | 109.2 | 6.72 | 104.5 |
| 60 | 4.86 | 125.1 | | | 6.76 | 109.1 | 6.50 | 100.4 |

All cited references, patents, or patent applications in the above application for letters patent are herein incorporated by reference in their entirety, or specified portion thereof, in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A coated abrasive article comprising:

a backing and an abrasive layer adhered to the backing by a make coat;

wherein the abrasive layer comprises;

a patterned abrasive layer of multiplexed abrasive structures, the multiplexed abrasive structures comprising two or more shaped abrasive particles in close proximity to each other, wherein the shaped abrasive particles comprise a width, and a spacing between each shaped abrasive particle in the multiplexed abrasive structure is less than the width of each shaped abrasive particle in the multiplexed abrasive structure; and each multiplexed abrasive structure spaced a predetermined distance from adjacent multiplexed abrasive structures forming the patterned abrasive layer.

2. The coated abrasive article of claim 1 wherein the multiplexed structures comprise from 2 to 10 shaped abrasive particles.

3. The coated abrasive article of claim 1 wherein the multiplexed structures comprise from 2 to 5 shaped abrasive particles.

4. The coated abrasive article of claim 1 wherein the shaped abrasive particles comprise triangular shaped abrasive particles each having a pair of opposing faces and the pair of opposing faces on each of the shaped abrasive particles in the multiplexed abrasive structure are parallel to one another.

5. The coated abrasive article of claim 4 wherein the patterned abrasive layer comprises parallel lines of the multiplexed abrasive structures.

6. The coated abrasive article of claim 1 wherein the patterned abrasive layer comprises parallel lines of the multiplexed abrasive structures.

7. The coated abrasive article of claim 4 wherein the patterned abrasive layer comprises a plurality of concentric circles of the multiplexed abrasive structures.

8. The coated abrasive article of claim 1 wherein the patterned abrasive layer comprises plurality of concentric circles of the multiplexed abrasive structures.

9. The coated abrasive article of claim 4 wherein the patterned abrasive layer comprises a spiral pattern of the multiplexed abrasive structures.

10. The coated abrasive article of claim 1 wherein the patterned abrasive layer comprises a spiral pattern of the multiplexed abrasive structures.

11. The coated abrasive article of claim 1 wherein the patterned abrasive layer comprises the multiplexed abrasive structures in combination with individual shaped abrasive particles.

12. The coated abrasive article of claim 1 wherein the patterned abrasive layer comprises the multiplexed abrasive structures in combination with crushed abrasive particles.

13. The coated abrasive article of claim 1 wherein the spacing between each shaped abrasive particle in the multiplexed abrasive structure is less than one of ¾, ½, or ¼ the width of the shaped abrasive particles in the multiplexed abrasive structure.

14. The coated abrasive article of claim 1 wherein each shaped abrasive particle in the multiplexed abrasive structure is touching an adjacent shaped abrasive particle.

15. The coated abrasive article of claim 1 wherein a rotational orientation about a Z axis extending from the patterned abrasive layer of each shaped abrasive particle in the multiplexed abrasive structure is substantially the same.

16. The coated abrasive article of claim 15 wherein an X direction and a Y direction are defined in the plane of the patterned abrasive layer, wherein the multiplexed abrasive structures are spaced a predetermined distance in the X and Y directions from adjacent multiplexed abrasive structures forming the patterned abrasive layer.

17. The coated abrasive article of claim 15 wherein each shaped abrasive particle in the multiplexed abrasive structure has a rotational orientation within one of ±30 degrees, ±20 degrees, ±10 degrees, or ±5 degrees.

18. The coated abrasive article of claim 17 wherein each shaped abrasive particle in the multiplexed abrasive structure has a rotational orientation within ±10 degrees.

19. The coated abrasive article of claim 18 wherein each shaped abrasive particle in the multiplexed abrasive structure has a rotational orientation within ±5 degrees.

* * * * *